US011198042B2

(12) United States Patent
Simone et al.

(10) Patent No.: US 11,198,042 B2
(45) **Date of Patent: *Dec. 14, 2021**

(54) HIGH DENSITY OUTER LAYER OF A GOLF CLUB HEAD

(71) Applicant: KARSTEN MANUFACTURING CORPORATION, Phoenix, AZ (US)

(72) Inventors: Matthew W. Simone, Phoenix, AZ (US); Ryan M. Stokke, Anthem, AZ (US)

(73) Assignee: KARSTEN MANUFACTURING CORPORATION, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/103,729

(22) Filed: Nov. 24, 2020

(65) Prior Publication Data

US 2021/0077864 A1 Mar. 18, 2021

Related U.S. Application Data

(63) Continuation of application No. 16/544,766, filed on Aug. 19, 2019, now Pat. No. 10,843,047, which is a continuation of application No. 15/872,733, filed on Jan. 16, 2018, now Pat. No. 10,427,010, which is a (Continued)

(51) Int. Cl.

| | |
|---|---|
| ***A63B 53/04*** | (2015.01) |
| ***A63B 60/00*** | (2015.01) |
| ***A63B 53/02*** | (2015.01) |

(52) U.S. Cl.

CPC ..... *A63B 53/04* (2013.01); *A63B 53/02* (2013.01); *A63B 53/0466* (2013.01); *A63B 60/00* (2015.10); *A63B 53/042* (2020.08); *A63B 53/047* (2013.01); *A63B 53/0433* (2020.08); *A63B 53/0437* (2020.08); (Continued)

(58) Field of Classification Search

CPC ..... A63B 53/04; A63B 60/00; A63B 53/02; A63B 53/0466; A63B 2053/0491; A63B 53/0487; A63B 2209/00; A63B 53/047; A63B 2053/0479; A63B 53/042; A63B 53/0433; A63B 53/0437

USPC ..... 473/324–350, 287–292

See application file for complete search history.

(56) References Cited

U.S. PATENT DOCUMENTS

| | | | |
|---|---|---|---|
| 5,272,802 | A | 12/1993 | Stites |
| 5,501,459 | A | 3/1996 | Endo |
| 5,851,158 | A | 12/1998 | Winrow |

(Continued)

FOREIGN PATENT DOCUMENTS

| | | | |
|---|---|---|---|
| CA | 2271573 | A1 | 11/1999 |
| JP | 08052243 | A | 2/1996 |

(Continued)

OTHER PUBLICATIONS

International Search Report and Written Opinion dated Aug. 31, 2016 from corresponding PCT Application No. PCT/US2016/033344, filed May 19, 2016.

*Primary Examiner* — Sebastiano Passaniti

(57) ABSTRACT

Embodiments of a golf club head comprising a body having a body material density, a strike face having a strike face material density, and a coating comprising a coating material having a coating material density greater than the body material density or the strike face material density are described herein.

14 Claims, 11 Drawing Sheets

Related U.S. Application Data continuation-in-part of application No. 15/159,623, filed on May 19, 2016, now abandoned.

(60) Provisional application No. 62/447,226, filed on Jan. 17, 2017, provisional application No. 62/163,888, filed on May 19, 2015.

(52) U.S. Cl.
CPC ... *A63B 53/0487* (2013.01); *A63B 2053/0479* (2013.01); *A63B 2053/0491* (2013.01); *A63B 2209/00* (2013.01)

(56) References Cited

U.S. PATENT DOCUMENTS

| | | | | |
|---|---|---|---|---|
| 6,010,411 | A | 1/2000 | Reyes | |
| 6,059,670 | A | 5/2000 | Mogan | |
| 7,166,041 | B2 | 1/2007 | Evans | |
| 7,214,143 | B2 | 8/2007 | Deshmukh | |
| 7,429,219 | B2 | 9/2008 | Huang | |
| 8,033,931 | B2 | 10/2011 | Wahl | |
| 8,303,433 | B2 | 11/2012 | Roach et al. | |
| 8,608,592 | B2 | 12/2013 | Deng et al. | |
| 8,938,871 | B2 | 1/2015 | Roach et al. | |
| 9,440,121 | B2 | 9/2016 | Deng et al. | |
| 10,427,010 | B2 * | 10/2019 | Simone | A63B 53/0466 |
| 10,843,047 | B2 * | 11/2020 | Simone | A63B 53/02 |
| 2013/0065706 | A1 | 3/2013 | Park | |
| 2013/0130830 | A1 | 5/2013 | Boyd | |

FOREIGN PATENT DOCUMENTS

| | | | |
|---|---|---|---|
| JP | 08299506 | A | 11/1996 |
| WO | 2005089884 | | 9/2005 |
| WO | 2014042196 | A1 | 3/2014 |

* cited by examiner

HIGH DENSITY OUTER LAYER OF A GOLF CLUB HEAD

CROSS REFERENCES

This is a continuation of U.S. patent application Ser. No. 16/544,766 filed Aug. 19, 2019, which is a continuation of U.S. patent application Ser. No. 15/872,733 filed Jan. 16, 2018, now U.S. Pat. No. 10,427,010 issued Oct. 1, 2019, which claims benefit to U.S. Provisional Patent Application No. 62/447,226, filed on Jan. 17, 2017, and which is a continuation-in-part of U.S. patent application Ser. No. 15/159,623, filed May 19, 2016, which claims benefit of U.S. Provisional Patent Application No. 62/163,888, filed May 19, 2015, all of which are incorporated herein by reference.

FIELD OF INVENTION

The present disclosure relates to golf clubs having golf club heads with a high density thin outer layer. Specifically, the present disclosure relates to wood-type golf club heads, iron-type golf club heads, wedge-type golf club heads, and putter-type golf club heads.

BACKGROUND

Golf club heads may include wood-type club heads (e.g., drivers and fairway woods), iron-type club heads (e.g., irons and wedges), and putter-type club heads. Golf club head designs vary and generally aim to optimize head center of gravity position and increase club head moment of inertia. The head center of gravity position affects performance characteristics of the golf club including direction, trajectory, distance, and spin of the golf ball. Increased club head moment of inertia increases the consistency of ball trajectory and direction for off-center hits. Many golf club heads are designed to optimize head center of gravity position and increase club head moment of inertia by using weighting ports or inserts. These designs may require complicated manufacturing and assembly processes and do not easily allow for optimization of head center of gravity position with precision. In addition, use of weighting ports can affect the overall aerodynamics of the club head. Therefore, there is a need in the art for the ability to distribute weight of golf club heads more precisely to optimize center of gravity positions and increase club head moment of inertia.

Figure 1:
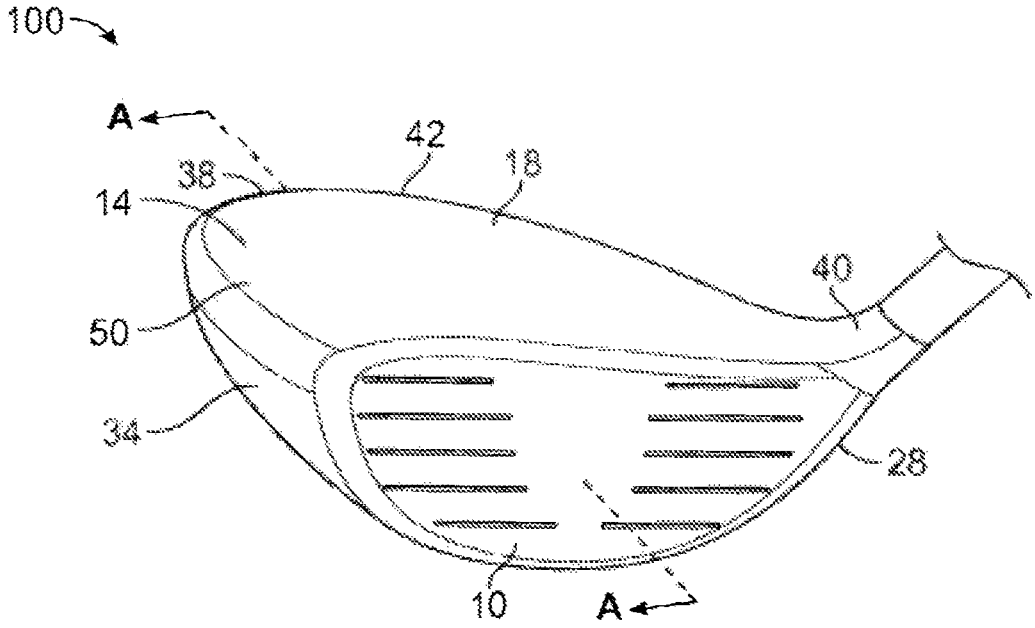
FIG. 1 illustrates a perspective view of a golf club head.

For illustrative purposes, the drawings described above may not represent actual scaling of the size of the coating or plurality of coatings relative to the club head size. For example, the coating thickness to club head thickness ratio may be shown as larger in the drawings than the actual coating thickness to club head thickness ratio per the dimensions disclosed within the detailed description.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

In the embodiments described below, a high density thin outer layer of material or coating is applied to a golf club head. By distributing a high density thin outer layer of material over a portion or the entire golf club head, the weight distribution of the golf club head can be controlled. This strategic placement of high density coating materials on the golf club head maximize distribution of the weight to the outermost perimeter of the club away from the center of gravity thereby maximizing the ability to increase the moment of inertia. The coating of high density material may be at any thickness or depth, but is suitable for very thin layers between 0.10 inches to as thin as 0.00001 inches. The coating of high density material can be applied to a surface of the club head by vapor deposition, plasma spray, plating, or spotting. Therefore, greater precision can be achieved for particular weight placement on the golf club head at a desired depth or thickness using a variable set of metal alloy materials. Being able to control these variables using high density materials can be used to optimize the head center of gravity and maximize the club head moment of inertia to achieve desired performance characteristics of the club head.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Discretionary weight, as described herein, refers to a portion of the total weight of the club head that can be positioned to optimize performance without impacting the structural integrity of the club head.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 2:
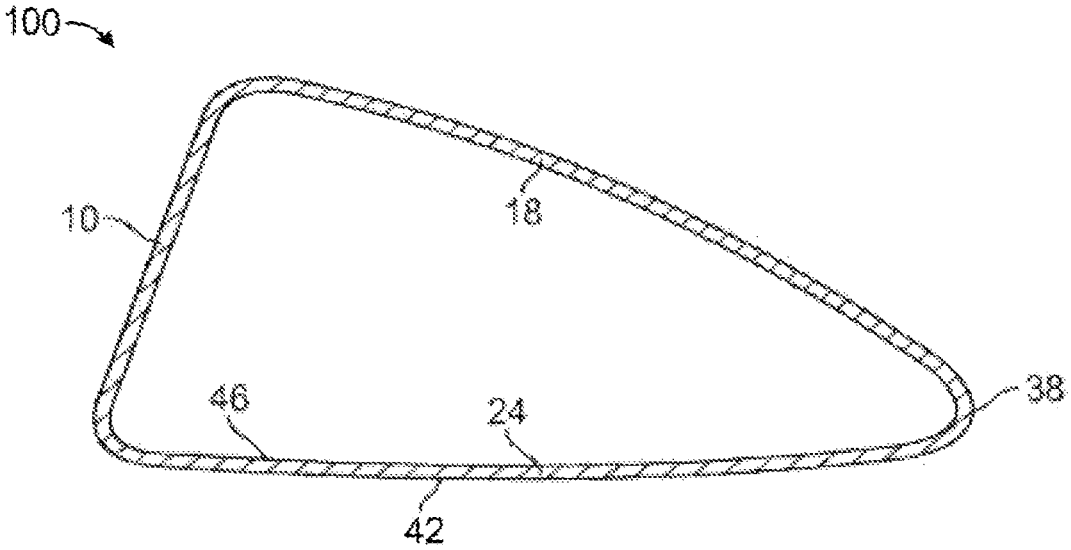
FIG. 2 illustrates a cross-sectional view of the golf club head of FIG. 1 taken along line A-A.

FIGS. 1-2 illustrate an embodiment of a golf club head 100 having a strike face 10 and a body 14 including a crown 18, a sole 24 opposite the crown 18, a heel 28, a toe 34 opposite the heel 28, and a back end 38. The body 14 and the strike face 10 together form the club head 100 having an outer surface 42 and an inner surface 46, as illustrated in the cross-sectional view of the club head 100 taken along line A-A in FIG. 2.

The body 14 of the club head 100 comprises a body material having a body material density. The body material may be any suitable material including titanium, stainless steel, tungsten, aluminum, other metals, composites, metal alloys, or any other material. In some embodiments, the body 14 of the club head 100 comprises different materials having different densities. For example, the crown 18 may comprise a crown material having a crown material density and the sole 24 may comprise a sole material having a sole material density, wherein the sole material and sole material density are different than the crown material and crown material density, respectively. In this example, the crown material density may be greater than the sole material density, or the crown material density may be less than the sole material density. In embodiments where the body 14 comprises different materials having different densities, the densities of each body material may be averaged to represent the body material density.

The strike face 10 of the club head 100 comprises a strike face material having a strike face material density. The strike face material may be any suitable material including titanium, stainless steel, tungsten, aluminum, other metals, composites, metal alloys, or any other material. In other embodiments, the strike face 10 may comprise different materials having different densities. When the strike face 10 comprises different materials having different densities, the densities of each strike face material may be averaged to represent the strike face material density.

The body material may be the same as the strike face material, or the body material may be different than the strike face material. Further, the body material density may be the same as the strike face material density, or the body material density may be different than the strike face material density. For example, the strike face material density may be higher than the body material density, or the strike face material density may be lower than the body material density. The club head 100 may further include a coating or plurality of coatings 50, as described in further detail in the embodiments of FIGS. 3-18 below.

In some embodiments, the club head 100 can include one coating 50 comprising a coating material having a coating material density (e.g. the embodiments of the club head illustrated FIGS. 3-14 and described in further detail below). In some embodiments, the club head can include more than one coating. For example, in some embodiments the club head 100 can include a first coating $\mathbf{50}_1$ comprising a first coating material having a first coating density, and a second coating $\mathbf{50}_2$ comprising a second coating material having a second coating density (e.g. the embodiments of the club head illustrated FIGS. 15-18 and described in further detail below).

In many embodiments, the coating 50 has a surface area, a weight, and a thickness 56 defining a thickness profile. The surface area of the coating 50 defines a perimeter 62 (illustrated in FIGS. 10-14) when specific portions of the club head 100 are covered by the coating 50. In embodiments where the coating 50 includes a plurality of coatings 50, the plurality of coatings can include a first coating $\mathbf{50}_1$ and a second coating $\mathbf{50}_2$, the first coating $\mathbf{50}_1$ having a first surface area, a first weight, and a first thickness $\mathbf{56}_1$ defining a first thickness profile, and the second coating $\mathbf{50}_2$ having a second surface area, a second weight, a second thickness $\mathbf{56}_2$ defining a second thickness profile. The coating or plurality of coatings 50 can be applied to the club head 100 in various positions or plurality of positions, as described further in the embodiments of FIGS. 3-14 below. In some embodiments, the coating 50 can be applied directly onto one or both of the outer surface of the club head body 14 and the strike face 10 of the club head 100. In some embodiments, one or more of the coatings of the plurality of coatings 50 can be applied directly onto another one of the coatings of the plurality of coatings 50.

Figure 3:
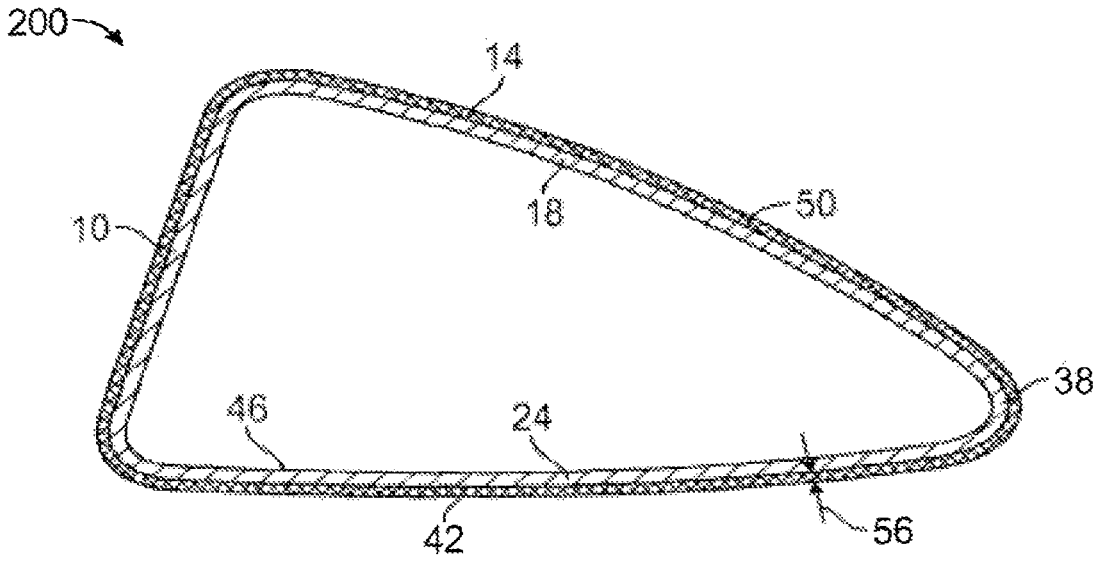
FIG. 3 illustrates a cross-sectional view of one embodiment of a golf club head having a coating.

FIG. 3 illustrates an embodiment of the club head 200 having a strike face 10 and a body 14 including a crown 18, a sole 24 opposite the crown 18, a heel 28, a toe 34 opposite the heel 28, and a back end 38. The body 14 and the strike face 10 together form the club head 200 having an outer surface 42 and an inner surface 46. The club head 200 further includes a coating 50.

Referring to FIG. 3, in the illustrated embodiment, the coating 50 is positioned on the outer surface 42 of the club head 200. Further, the coating 50 covers or is positioned over the entire outer surface 42 of the club head 200 including the strike face 10 and the body 14. Accordingly, in the illustrated embodiment, the strike face 10, the crown 18, the sole 24, the heel 28, the toe 34, and the back end 38 of the club head 200 are covered by the coating 50. In the illustrated embodiment, the thickness 56 of the coating 50 is approximately constant. For example, the thickness 56 of the coating 50 on the crown 18 is approximately the same as the thickness on the sole 24, the heel 28, the toe 34, the back end 38, and the strike face 10.

Figure 4:
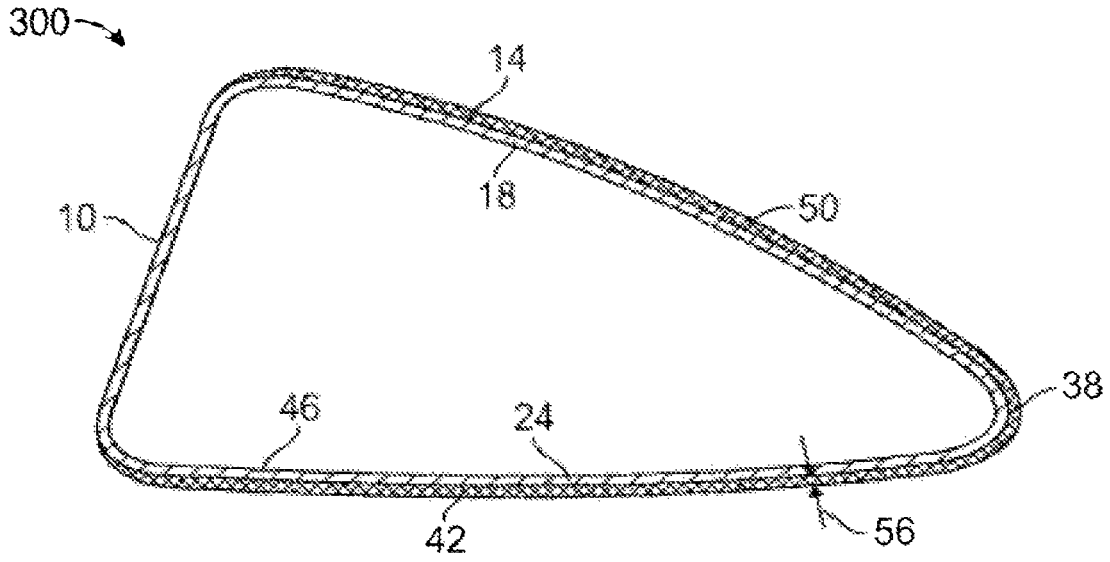
FIG. 4 illustrates a cross-sectional view of another embodiment of a golf club head having a coating.

FIG. 4 illustrates another embodiment of the club head 300 having a strike face 10 and a body 14 including a crown 18, a sole 24 opposite the crown 18, a heel 28, a toe 34 opposite the heel 28, and a back end 38. The body 14 and the strike face 10 together form the club head 300 having an outer surface 42 and an inner surface 46. The club head 300 further includes a coating 50.

Referring to FIG. 4, in the illustrated embodiment, the coating 50 is positioned on the outer surface 42 of the club head 200. Further, in the illustrated embodiment, the coating 50 covers or is positioned over a portion of the outer surface 42 of the club head 300. Specifically, the coating 50 covers or is positioned over the body 14 of the club head 300 including the crown 18, the sole 24, the heel 28, the toe 34, and the back end 38. Accordingly, the crown 18, the sole 24, the heel 28, the toe 34, and the back end 38 are covered by the coating 50. The strike face 10 is not covered by the coating 50.

Further referring to FIG. 4, in the illustrated embodiment, the thickness 56 of the coating 50 is approximately constant. For example, the thickness 56 of the coating 50 on the crown 18 is approximately the same as the thickness on the sole 24, the heel 28, the toe 34, and the back end 38. Further, the thickness 56 of the coating 50 tapers or decreases near the edges of the coating 50 (e.g. near the periphery of the strike face 10). For example, in the illustrated embodiment, the thickness of the coating 50 tapers or decreases near the strike face 10 of the club head 200.

Figure 5:
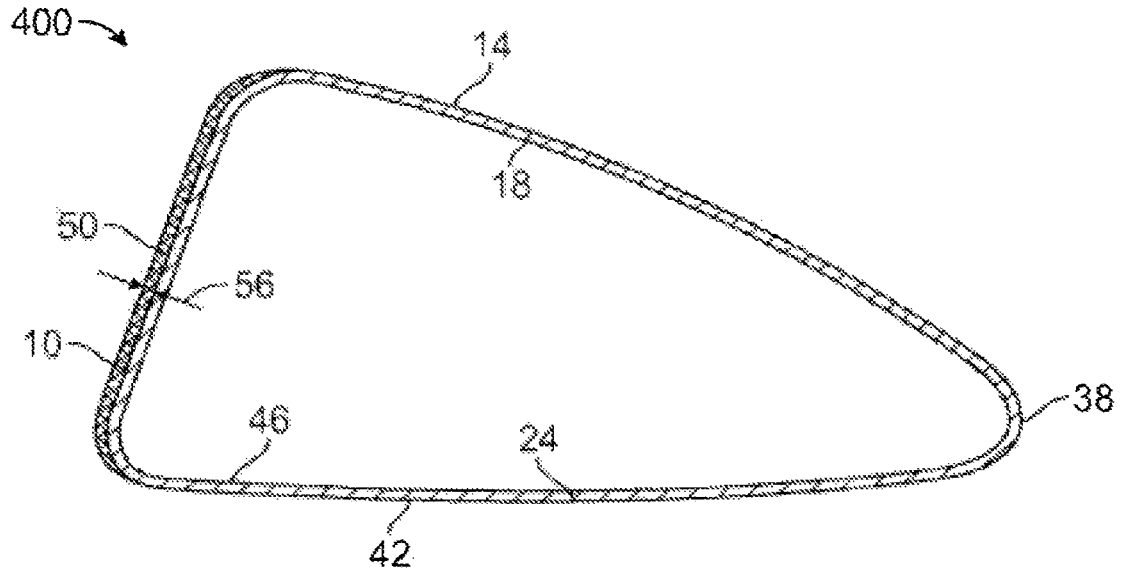
FIG. 5 illustrates a cross-sectional view of another embodiment of a golf club head having a coating.

FIG. 5 illustrates another embodiment of the club head 400 having a strike face 10 and a body 14 including a crown 18, a sole 24 opposite the crown 18, a heel 28, a toe 34 opposite the heel 28, and a back end 38. The body 14 and the strike face 10 together form the club head 400 having an outer surface 42 and an inner surface 46. The club head 400 further includes a coating 50.

In the illustrated embodiment, the coating 50 is positioned on the outer surface 42 of the club head 400. Further, in the illustrated embodiment, the coating 50 covers or is positioned over a portion of the outer surface 42 of the club head 400. Specifically, the coating 50 covers or is positioned over the strike face 10 of the club head 400. Further, in the illustrated embodiment, the thickness 56 of the coating 50 is approximately constant. For example, the thickness 56 of the coating 50 on the strike face 10 near the heel 28, the toe 34, the crown 18, or the sole 24 is approximately the same. Further, the thickness 56 of the coating 50 tapers or decreases near the edges of the coating 50. For example, the thickness of the coating 50 tapers or decreases near the periphery of the strike face 10.

Figure 6:
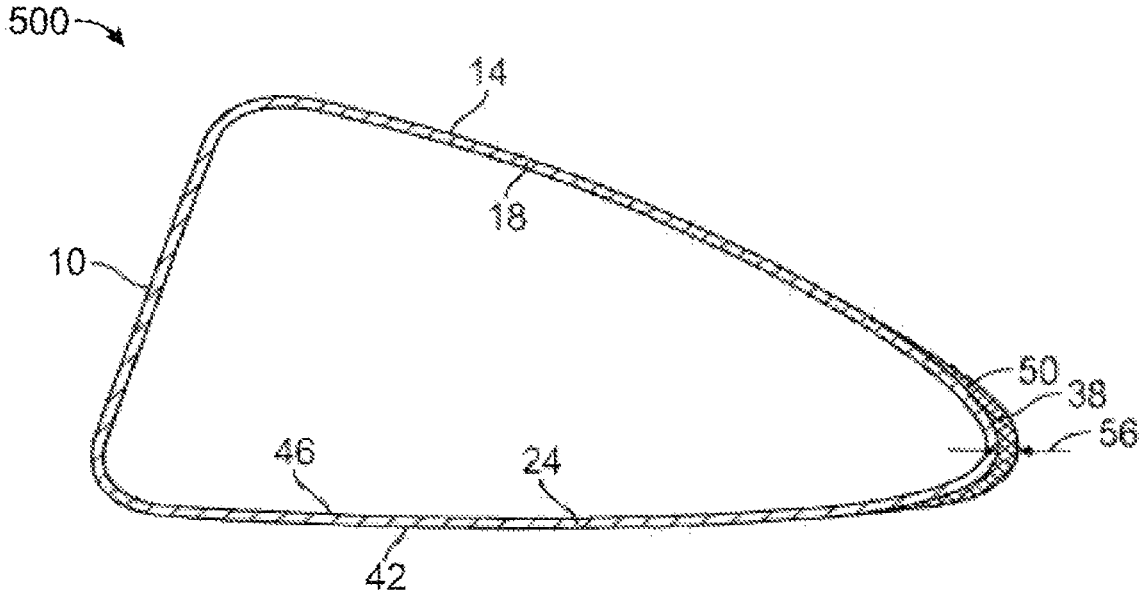
FIG. 6 illustrates a cross-sectional view of another embodiment of a golf club head having a coating.

FIG. 6 illustrates another embodiment of the club head 500 having a strike face 10 and a body 14 including a crown 18, a sole 24 opposite the crown 18, a heel 28, a toe 34 opposite the heel 28, and a back end 38. The body 14 and the strike face 10 together form the club head 500 having an outer surface 42 and an inner surface 46. The club head 500 further includes a coating 50.

Referring to FIG. 6, in the illustrated embodiment, the coating 50 is positioned on the outer surface 42 of the club head 500. Further, in the illustrated embodiment, the coating 50 covers or is positioned over a portion of the outer surface 42 of the club head 500. Specifically, the coating 50 covers or is positioned over at least a portion of the back end 38 of the club head 500. In some embodiments, the coating 50 can extend along the entire back end 38 from the heel 28 to the toe 34 of the club head 500. Further, in some embodiments, the coating 50 can extend along a portion of the back end 38 of the club head 500. For example, in some embodiments, the coating 50 can extend along the back end 38 from near the heel 28 to near the toe 34 of the club head 500.

Further referring to FIG. 6, in the illustrated embodiment, the thickness 56 of the coating 50 is greatest near the rearward most part of the back end 38 and gradually tapers or decreases near the edges of the coating 50 toward the crown 18 and the sole 24. For example, the thickness of the coating 50 tapers or decreases near the crown 18 and the sole 24 of the club head 500.

Figure 7:
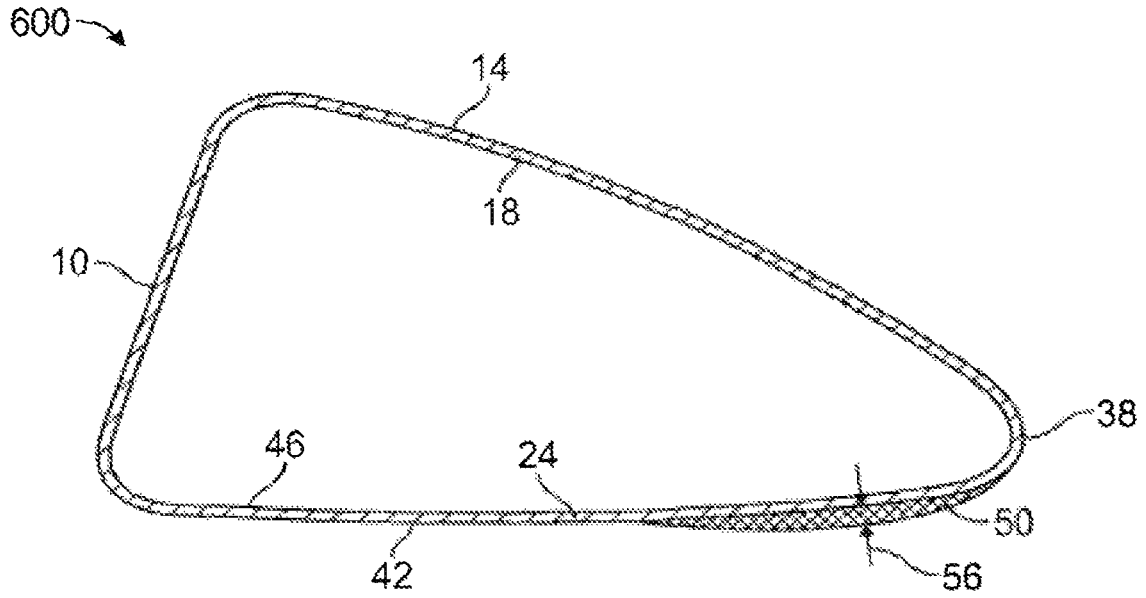
FIG. 7 illustrates a cross-sectional view of another embodiment of a golf club head having a coating.

FIG. 7 illustrates another embodiment of the club head 600 having a strike face 10 and a body 14 including a crown 18, a sole 24 opposite the crown 18, a heel 28, a toe 34 opposite the heel 28, and a back end 38. The body 14 and the strike face 10 together form the club head 600 having an outer surface 42 and an inner surface 46. The club head 600 further includes a coating 50.

Referring to FIG. 7, in the illustrated embodiment, the coating 50 is positioned on the outer surface 42 of the club head 600. Further, in the illustrated embodiment, the coating 50 covers or is positioned over a portion of the outer surface 42 of the club head 600. Specifically, the coating 50 covers or is positioned over a portion of the sole 24 near the back end 38 of the club head 600. In some embodiments, the coating 50 can extend along the entire length of the sole 24 from near the heel 28 to near the toe 34 of the club head 600. Further, in some embodiments, the coating 50 can extend along only a portion of the sole 24. In the illustrated embodiment, the thickness 56 of the coating 50 gradually tapers or decreases near the edges of the coating 50 toward the back end 38 and the strike face 10.

Figure 8:
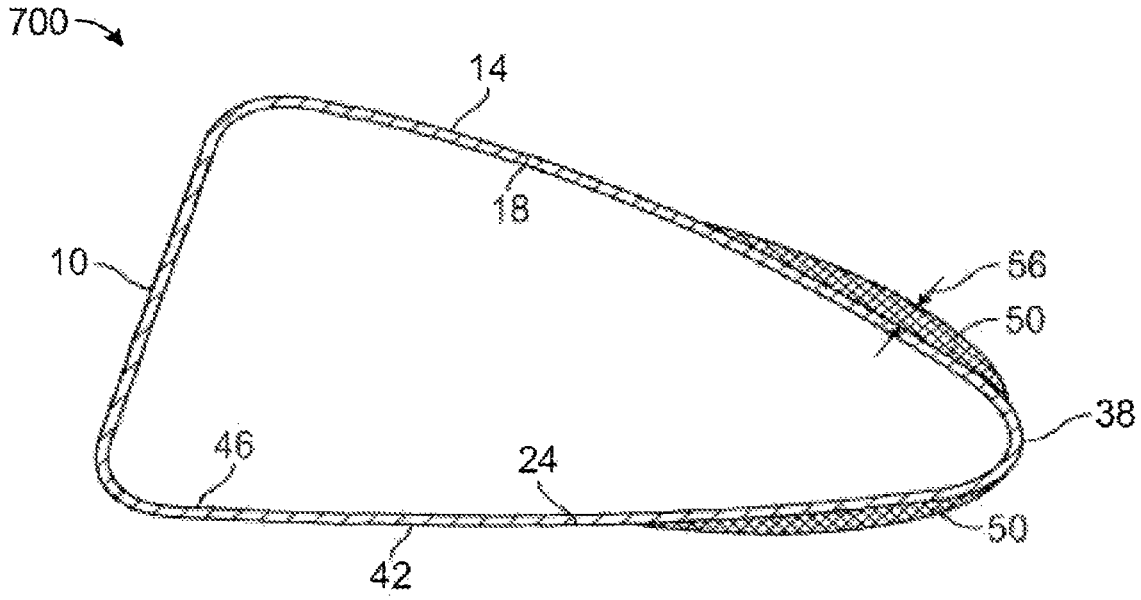
FIG. 8 illustrates a cross-sectional view of another embodiment of a golf club head having a coating.

FIG. 8 illustrates another embodiment of the club head 700 having a strike face 10 and a body 14 including a crown 18, a sole 24 opposite the crown 18, a heel 28, a toe 34 opposite the heel 28, and a back end 38. The body 14 and the strike face 10 together form the club head 700 having an outer surface 42 and an inner surface 46. The club head 700 further includes a coating 50 having more than one discrete portion.

Referring to FIG. 8, in the illustrated embodiment, the coating 50 is positioned on the outer surface 42 of the club head 700. Further, in the illustrated embodiment, the coating 50 covers or is positioned over a portion of the outer surface 42 of the club head 700. Specifically, the coating 50 includes a first portion that covers or is positioned over a portion of the sole 24 near the back end 38 of the club head 600, and a second portion that covers or is positioned over a portion of the crown 18 near the back end 38 of the club head. In some embodiments, the first portion of the coating 50 can extend along the entire length of the sole 24 from near the heel 28 to near the toe 34 of the club head 700. Further, in some embodiments, the second portion of the coating 50 can extend along only a portion of the crown 18 from near the heel 28 to near the toe 34 of the club head 700. In the illustrated embodiment, the thickness 56 of the coating 50 gradually tapers or decreases near the edges of the first portion of the coating 50 on the sole 24 and near the edges of the second portion of the coating 50 on the crown 18.

Figure 9:
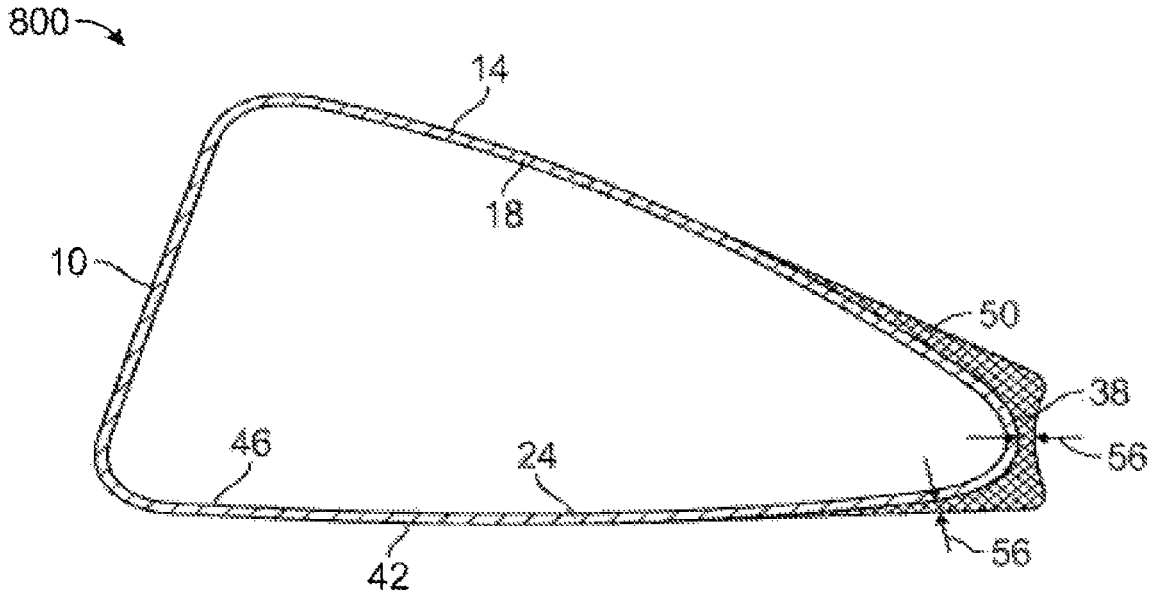
FIG. 9 illustrates a cross-sectional view of another embodiment of a golf club head having a coating.

FIG. 9 illustrates another embodiment of club head 800 having a strike face 10 and a body 14 including a crown 18, a sole 24 opposite the crown 18, a heel 28, a toe 34 opposite the heel 28, and a back end 38. The body 14 and the strike face 10 together form the club head 800 having an outer surface 42 and an inner surface 46. The club head 800 further includes a coating 50.

Referring to FIG. 9, in the illustrated embodiment, the coating 50 is positioned on the outer surface 42 of the club head 800. Further, in the illustrated embodiment, the coating 50 covers or is positioned over a portion of the outer surface 42 of the club head 800. Specifically, the coating 50 covers or is positioned over at least a portion of the back end 38 of the club head 800. In some embodiments, the coating 50 can extend along the entire back end 38 from the heel 28 to the toe 34 of the club head 800. Further, in some embodiments, the coating 50 can extend along a portion of the back end 38 of the club head 800. For example, in some embodiments, the coating 50 can extend along the back end 38 from near the heel 28 to near the toe 34 of the club head 800.

Further referring to FIG. 9, in the illustrated embodiment, the thickness 56 of the coating 50 varies defining a thickness profile. The thickness profile illustrated can be a bowtie contour of the coating 50 at the back end 38 of the club head 800. In the illustrated embodiment, the thickness 56 of the coating 50 gradually increases and then decreases in a direction from the back end 38 toward the crown 18 of the club head 800. Further, in the illustrated embodiment, the thickness 56 of the coating 50 gradually increases and then decreases in a direction from the back end 38 toward the sole 24 of the club head 800.

Figure 10A:
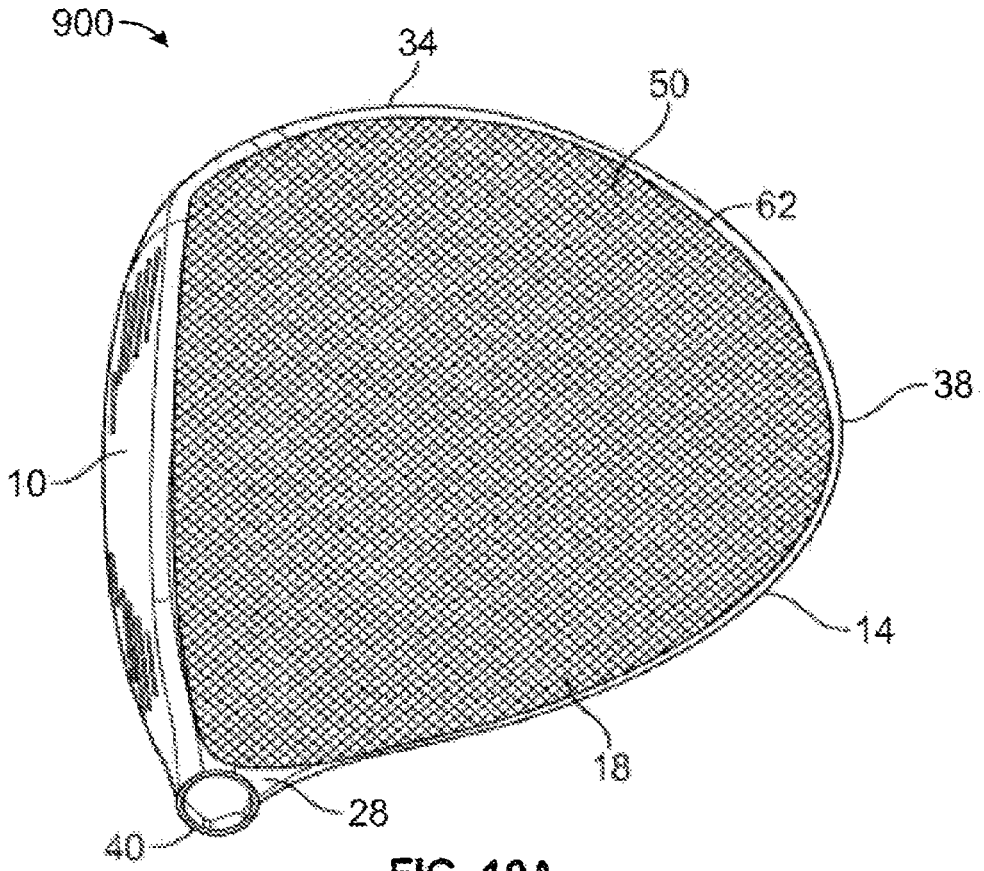
FIG. 10A illustrates a top view of another embodiment of a golf club head having a coating.
Figure 10B:
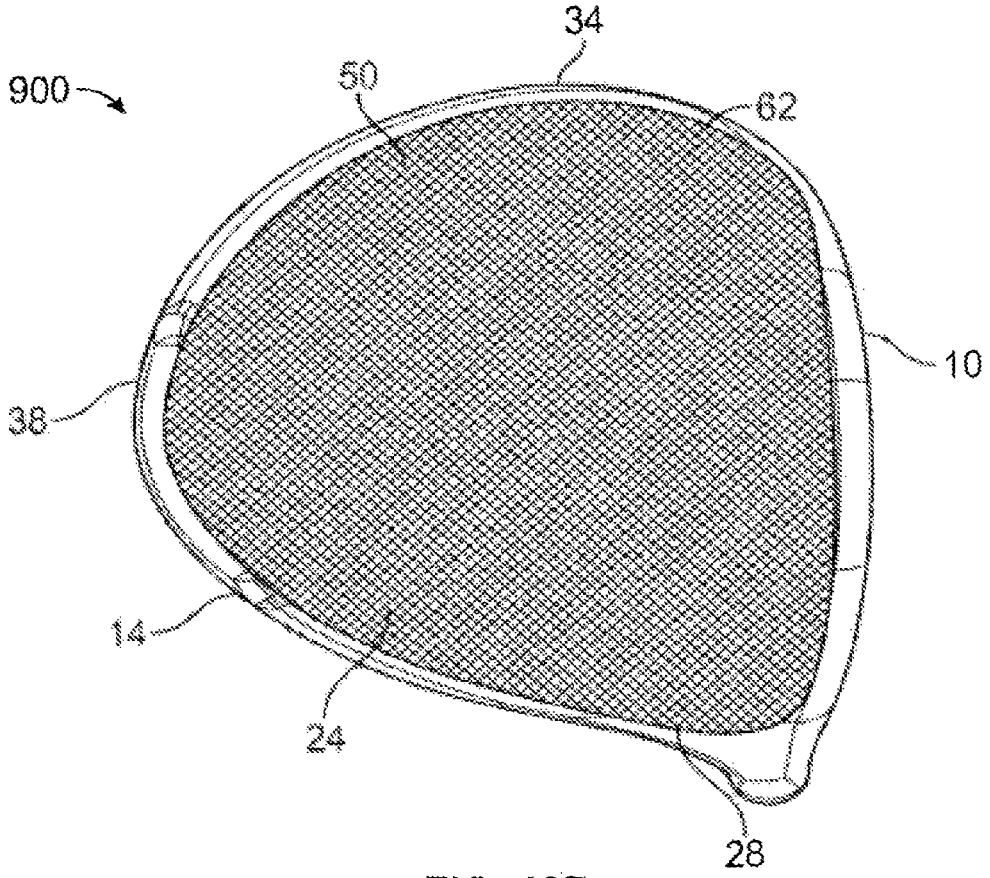
FIG. 10B illustrates a bottom view of the golf club head of FIG. 10A.

FIGS. 10A and 10B illustrate another embodiment of the club head 900 having a strike face 10 and a body 14 including a crown 18, a sole 24 opposite the crown 18, a heel 28, a toe 34 opposite the heel 28, and a back end 38. The body 14 and the strike face 10 together form the club head 900 having an outer surface 42 and an inner surface 46. The club head 900 further includes a coating 50 having more than one discrete portion.

Referring to FIGS. 10A and 10B, in the illustrated embodiment, the coating 50 is positioned on the outer surface 42 of the club head 900. Further, in the illustrated embodiment, the coating 50 covers or is positioned over a portion of the outer surface 42 of the club head 700. Specifically, in the illustrated embodiment, the coating 50 includes a first portion that covers or is positioned over the entire crown 18 (FIG. 10A) and a second portion that covers or is positioned over the entire sole 24 (FIG. 10B) of the club head 900. In the illustrated embodiment, the thickness 56 of the first portion of the coating 50 positioned on the crown 18 is approximately constant. Further, in the illustrated embodiment, the thickness 56 of the second portion of the coating 50 positioned on the sole 24 is approximately constant.

Figure 11:
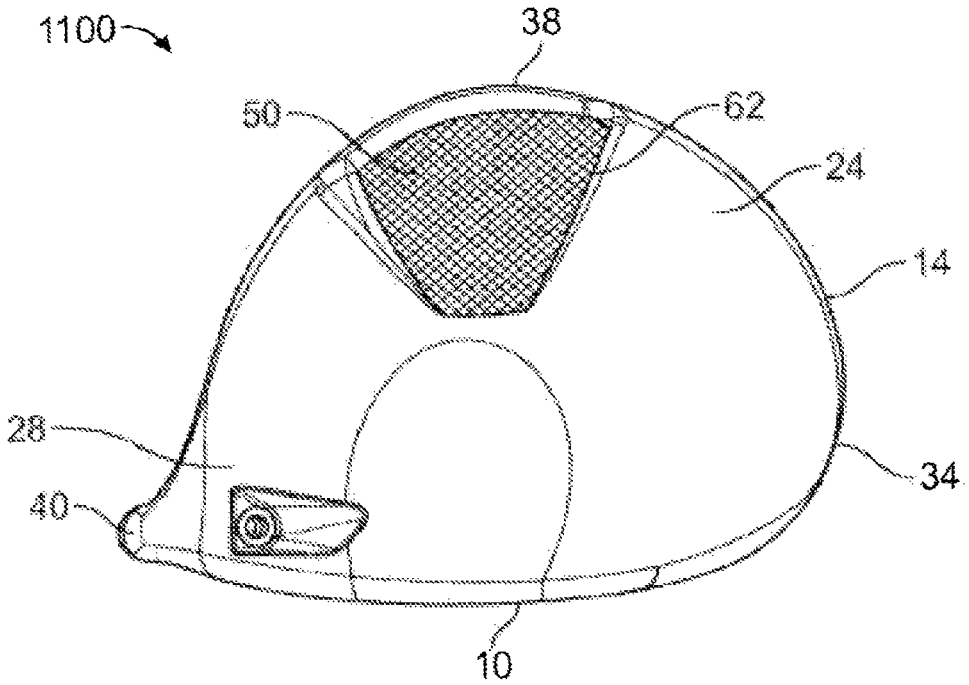
FIG. 11 illustrates a bottom view of another embodiment of a golf club head having a coating.

FIG. 11 illustrates another embodiment of the club head 1100 having a strike face 10 and a body 14 including a crown 18, a sole 24 opposite the crown 18, a heel 28, a toe 34 opposite the heel 28, and a back end 38. The body 14 and the strike face 10 together form the club head 1100 having an outer surface 42 and an inner surface 46. The club head 1100 further includes a coating 50.

Referring to FIG. 11, in the illustrated embodiment, the coating 50 is positioned on the outer surface 42 of the club head 1100. Further, in the illustrated embodiment, the coating 50 covers or is positioned over a portion of the outer surface 42 of the club head 600. Specifically, the coating 50 covers or is positioned over a portion of the sole 24 near the center region of the back end 38 of the club head 600. In some embodiments, the coating 50 covers a portion of the club head 600 having a weight pad or weight member. In some embodiments, the coating 50 directly contacts the outer surface 42 of the club head 1100. In the illustrated embodiment, the perimeter 62 of the coating 50 defines a trapezoidal shape, corresponding to the shape of the weight pad or weight member. The shape of the coating 50 can correspond to any weight pad or weight member that can be any shape such as a trapezoidal, square, hexagonal, circular, triangular, or any other polygon or shape with at least one curved surface. Further, in the illustrated embodiment, the thickness 56 of the coating 50 is approximately constant.

Figure 12:
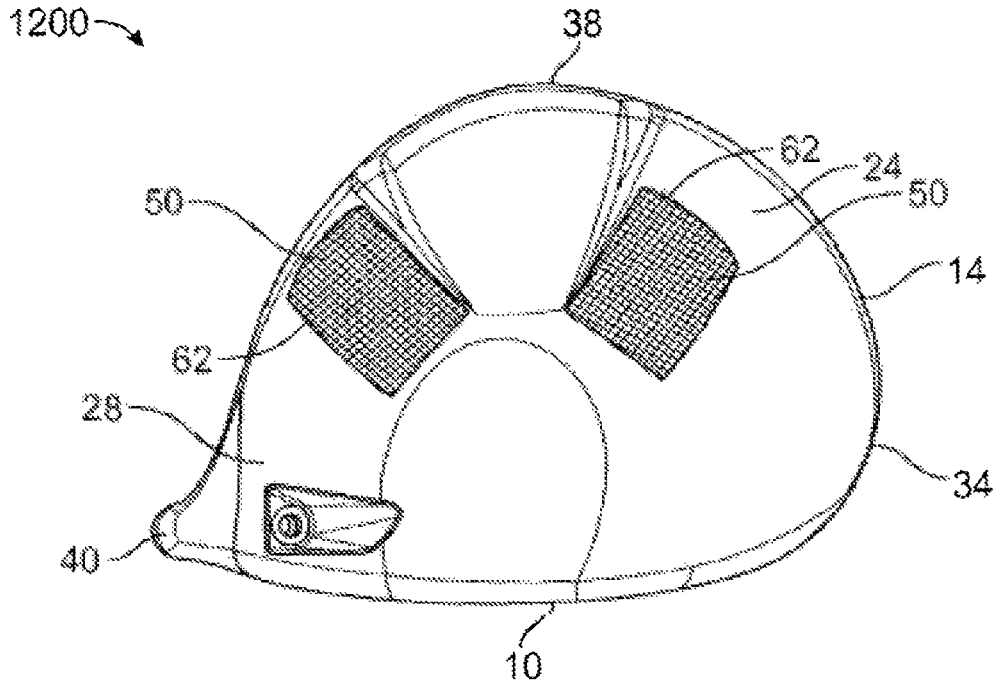
FIG. 12 illustrates a bottom view of another embodiment of a golf club head having a coating.

FIG. 12 illustrates another embodiment of the club head 1200 having a strike face 10 and a body 14 including a crown 18, a sole 24 opposite the crown 18, a heel 28, a toe 34 opposite the heel 28, and a back end 38. The body 14 and the strike face 10 together form the club head 1200 having an outer surface 42 and an inner surface 46. The club head 1200 further includes a coating 50 having more than one discrete portion.

Referring to FIG. 12, in the illustrated embodiment, the coating 50 is positioned on the outer surface 42 of the club head 1200. Further, in the illustrated embodiment, the coating 50 covers or is positioned over a portion of the outer surface 42 of the club head 1200. Specifically, the coating 50 includes a first portion that covers or is positioned over a portion of the sole 24 near the toe 34 (between the toe 34 and the rear end 38) and a second portion that covers or is positioned over a portion of the sole 24 near the heel 28 (between the heel 28 and the rear end 38) of the club head 1200. In some embodiments, the first portion is spaced equally between the rear end 38 and the toe 34. In some embodiments, the second portion is spaced equally between the rear end 38 and the heel 28. In the illustrated embodiment, the perimeter 62 of the first portion of the coating 50 defines a rectangular shape, and the perimeter 62 of the second portion of the coating 50 defines a rectangular shape. In some embodiments, a section of the perimeter 62 of the first portion abuts a weight pad or weight member of the golf club head 1200. In some embodiments, a section of the perimeter 62 of the second portion abuts a weight pad or weight member of the golf club head 1200. Further, in the illustrated embodiment, the thickness 56 of the coating 50 is approximately constant.

Figure 13:
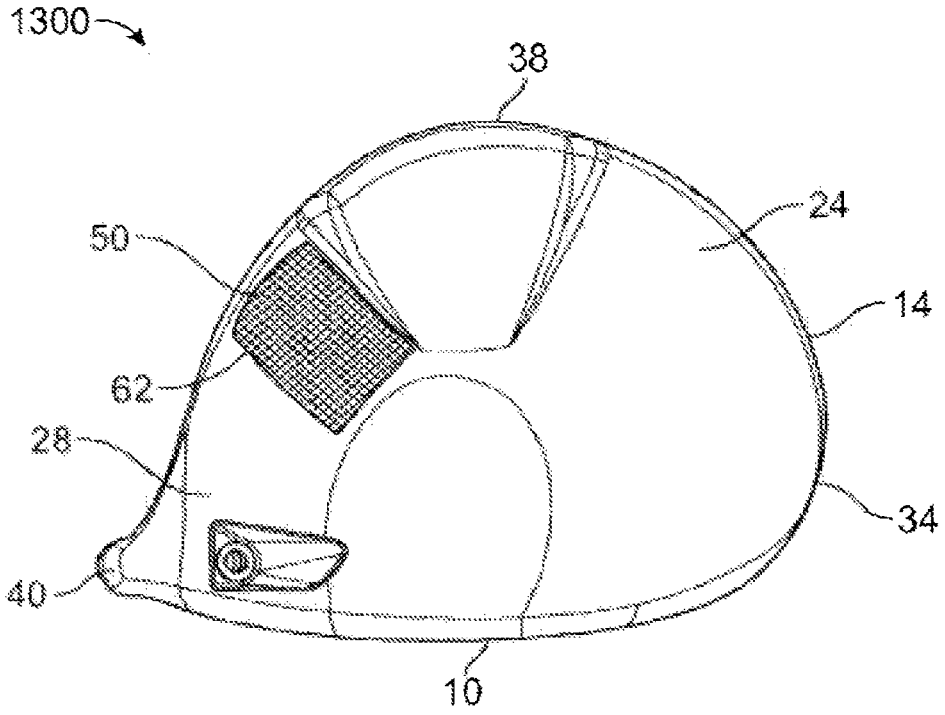
FIG. 13 illustrates a bottom view of another embodiment of a golf club head having a coating.

FIG. 13 illustrates another embodiment of the club head 1300 having a strike face 10 and a body 14 including a crown 18, a sole 24 opposite the crown 18, a heel 28, a toe 34 opposite the heel 28, and a back end 38. The body 14 and the strike face 10 together form the club head 1300 having an outer surface 42 and an inner surface 46. The club head 1300 further includes a coating 50.

Referring to FIG. 13, in the illustrated embodiment, the coating 50 is positioned on the outer surface 42 of the club head 1300. Further, in the illustrated embodiment, the coating 50 covers or is positioned over a portion of the outer surface 42 of the club head 1300. Specifically, the coating 50 is positioned over a portion of the sole 24 near the heel 28 of the club head 1200. In some embodiments, the coating 50 is spaced equally between the rear end 38 and the heel 28. In the illustrated embodiment, the perimeter 62 of the coating 50 defines a rectangular shape. In some embodiments, a section of the perimeter 62 of the coating 50 abuts a weight pad or weight member of the golf club head 1200.

Further, in the illustrated embodiment, the thickness 56 of the coating 50 is approximately constant.

Figure 14:
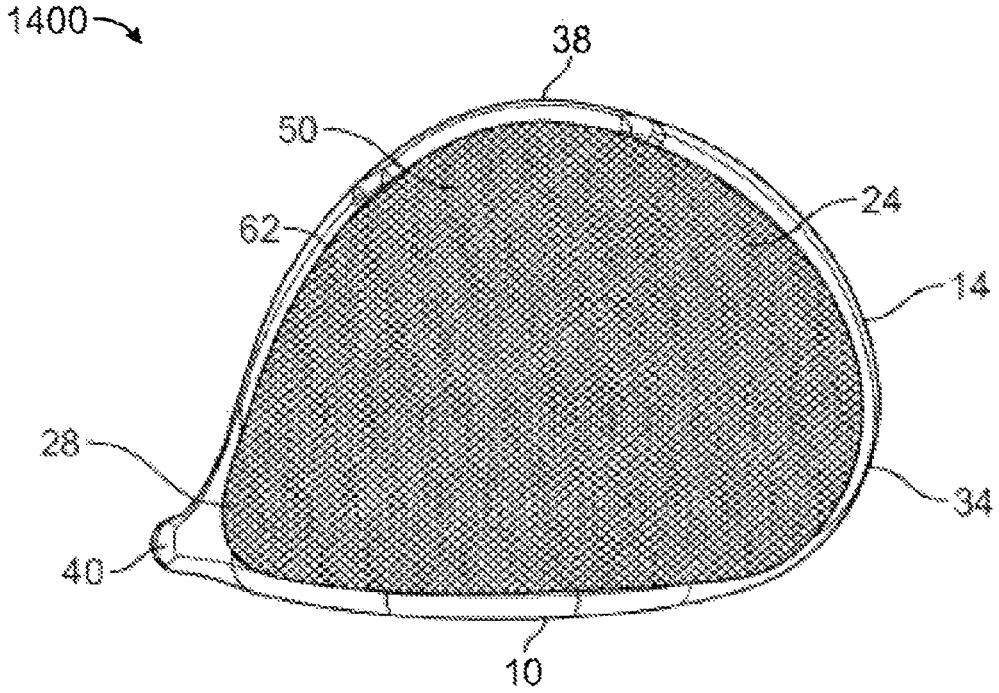
FIG. 14 illustrates a bottom view of another embodiment of a golf club head having a coating.

FIG. 14 illustrates another embodiment of the club head 1400 having a strike face 10 and a body 14 including a crown 18, a sole 24 opposite the crown 18, a heel 28, a toe 34 opposite the heel 28, and a back end 38. The body 14 and the strike face 10 together form the club head 1400 having an outer surface 42 and an inner surface 46. The club head 1400 further includes a coating 50.

Referring to FIG. 14, in the illustrated embodiment, the coating 50 is positioned on the outer surface 42 of the club head 1400. Further, in the illustrated embodiment, the coating 50 covers or is positioned over a portion of the outer surface 42 of the club head 1400. Specifically, the coating 50 is positioned over the entire sole 24 of the club head 1400. In the illustrated embodiment, the thickness 56 of the coating 50 is approximately constant.

Figure 15:
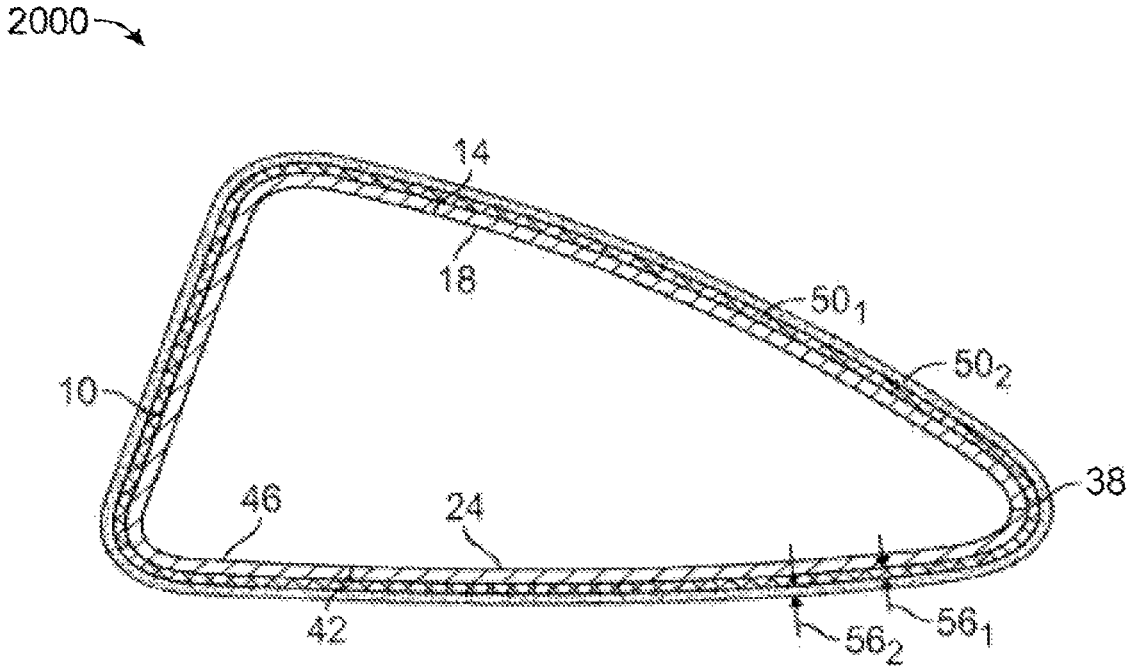
FIG. 15 illustrates a cross-sectional view of one embodiment of a golf club head having a first coating and a second coating.

FIG. 15 illustrates an embodiment of the club head 2000 having a strike face 10 and a body 14 including a crown 18, a sole 24 opposite the crown 18, a heel 28, a toe 34 opposite the heel 28, and a back end 38. The body 14 and the strike face 10 together form the club head 2000 having an outer surface 42 and an inner surface 46. The club head 2000 further includes a first coating $\mathbf{50}_1$ and second coating $\mathbf{50}_2$.

Referring to FIG. 15, in the illustrated embodiment, the first coating $\mathbf{50}_1$ is positioned on the outer surface 42 of the club head 2000. Further, the first coating $\mathbf{50}_1$ covers or is positioned over the entire outer surface 42 of the club head 2000 including the strike face 10 and the body 14. Accordingly, in the illustrated embodiment, the strike face 10, the crown 18, the sole 24, the heel 28, the toe 34, and the back end 38 of the club head 2000 are covered by the first coating $\mathbf{50}_1$. In the illustrated embodiment, the thickness $\mathbf{56}_1$ of the first coating $\mathbf{50}_1$ is approximately constant. For example, the thickness $\mathbf{56}_1$ of the first coating $\mathbf{50}_1$ on the crown 18 is approximately the same as the thickness $\mathbf{56}_1$ on the sole 24, the heel 28, the toe 34, the back end 38, and the strike face 10.

Further referring to FIG. 15, in the illustrated embodiment, the second coating $\mathbf{50}_2$ covers or is positioned over the first coating $\mathbf{50}_1$ of the club head 2000. In the illustrated embodiment, the thickness $\mathbf{56}_2$ of the second coating $\mathbf{50}_2$ is approximately constant. For example, the thickness $\mathbf{56}_2$ of the second coating $\mathbf{50}_2$ on the crown 18 is approximately the same as the thickness $\mathbf{56}_2$ on the sole 24, the heel 28, the toe 34, the back end 38, and the strike face 10.

Figure 16:
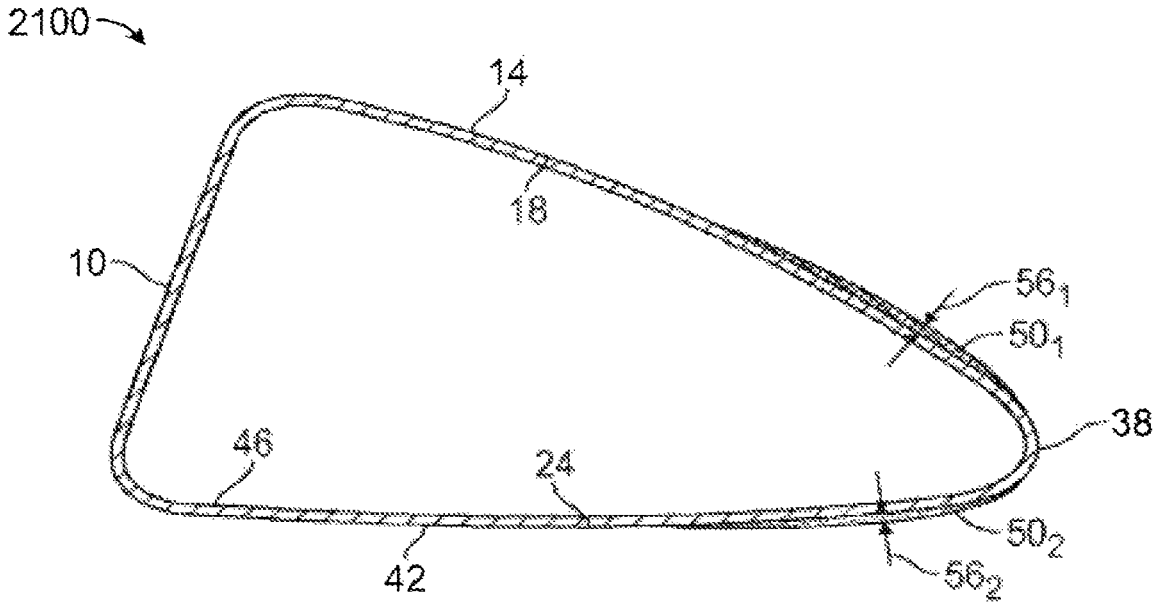
FIG. 16 illustrates a cross-sectional view of another embodiment of a golf club head having a first coating and a second coating.

FIG. 16 illustrates another embodiment of the club head 2100 having a strike face 10 and a body 14 including a crown 18, a sole 24 opposite the crown 18, a heel 28, a toe 34 opposite the heel 28, and a back end 38. The body 14 and the strike face 10 together form the club head 2100 having an outer surface 42 and an inner surface 46. The club head 2100 further includes a first coating $\mathbf{50}_1$ and second coating $\mathbf{50}_2$.

Referring to FIG. 16, in the illustrated embodiment, the first coating $\mathbf{50}_1$ is positioned on the outer surface 42 of the club head 2100. Further, in the illustrated embodiment, the first coating $\mathbf{50}_1$ covers or is positioned over a portion of the outer surface 42 of the club head 2100. Specifically, the first coating $\mathbf{50}_1$ covers or is positioned over a portion of the crown 18 near the back end 38 of the club head 2100. In some embodiments, the first coating $\mathbf{50}_1$ can extend along the entire length of the crown 18 from near the heel 28 to near the toe 34 of the club head 2100. In the illustrated embodiment, the thickness $\mathbf{56}_1$ of the first coating $\mathbf{50}_1$ gradually tapers or decreases near the edges of the first coating $\mathbf{50}_1$ on the crown 18.

Further referring to FIG. 16, in the illustrated embodiment, the second coating $\mathbf{50}_2$ is positioned on the outer surface 42 of the club head 2100. Further, in the illustrated embodiment, the second coating $\mathbf{50}_2$ covers or is positioned over a portion of the outer surface 42 of the club head 2100. Specifically, the second coating $\mathbf{50}_2$ covers or is positioned over a portion of the sole 24 near the back end 38 of the club head 2100. In some embodiments, the second coating $\mathbf{50}_2$ can extend along the entire length of the sole 24 from near the heel 28 to near the toe 34 of the club head 2100. In the illustrated embodiment, the thickness $\mathbf{56}_2$ of the second coating $\mathbf{50}_2$ gradually tapers or decreases near the edges of the second coating $\mathbf{50}_2$ on the sole 24.

Figure 17:
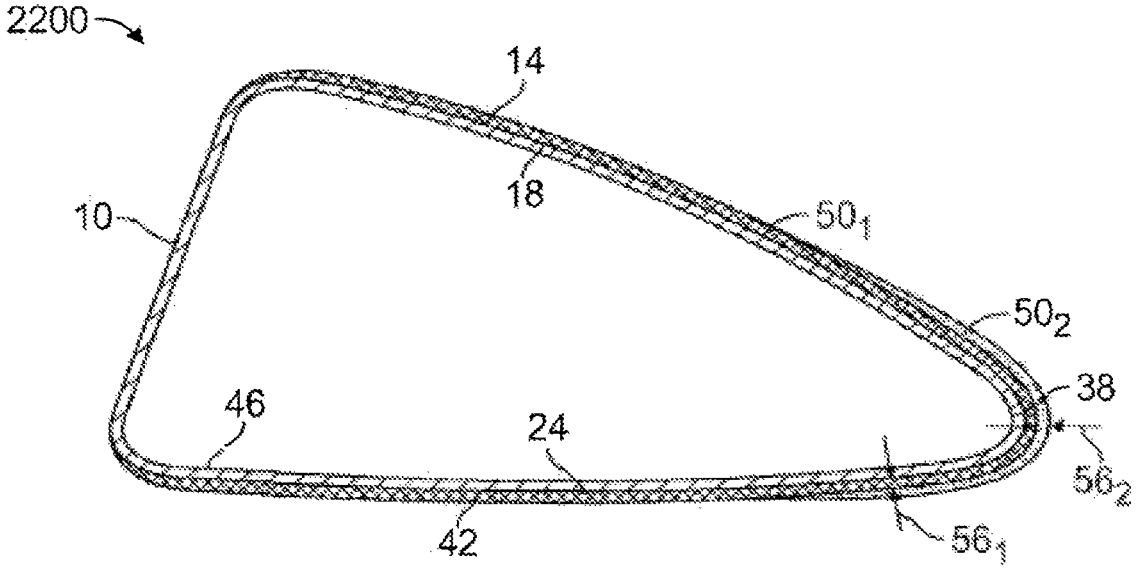
FIG. 17 illustrates a cross-sectional view of another embodiment of a golf club head having a first coating and a second coating.

FIG. 17 illustrates another embodiment of the club head 2200 having a strike face 10 and a body 14 including a crown 18, a sole 24 opposite the crown 18, a heel 28, a toe 34 opposite the heel 28, and a back end 38. The body 14 and the strike face 10 together form the club head 2200 having an outer surface 42 and an inner surface 46. The club head 2200 further includes a first coating $\mathbf{50}_1$ and second coating $\mathbf{50}_2$.

Referring to FIG. 17, in the illustrated embodiment, the first coating $\mathbf{50}_1$ is positioned on the outer surface 42 of the club head 2200. Further, the first coating $\mathbf{50}_1$ covers or is positioned over the entire body 14 of the club head 2200. Accordingly, the crown 18, the sole 24, the heel 28, the toe 34, and the back end 38 of the club head 2200 are covered by the first coating $\mathbf{50}_1$. In the illustrated embodiment, the thickness $\mathbf{56}_1$ of the first coating $\mathbf{50}_1$ is approximately constant. For example, the thickness $\mathbf{56}_1$ of the first coating $\mathbf{50}_1$ on the crown 18 is approximately the same as the thickness $\mathbf{56}_1$ on the sole 24, the heel 28, the toe 34, the back end 38, and the strike face 10.

Further referring to FIG. 17, in the illustrated embodiment, the second coating $\mathbf{50}_2$ covers or is positioned over a portion of the first coating $\mathbf{50}_1$ of the club head 2200 near the back end 38. In some embodiments, the second coating $\mathbf{50}_2$ can extend along the entire back end 38 from the heel 28 to the toe 34 of the club head 2200. Further, in some embodiments, the second coating $\mathbf{50}_2$ can extend along a portion of the back end 38 of the club head 2200. For example, in some embodiments, the second coating $\mathbf{50}_2$ can extend along the back end 38 from near the heel 28 to near the toe 34 of the club head 2200. In the illustrated embodiment, the thickness $\mathbf{56}_2$ of the second coating $\mathbf{50}_2$ is greatest near the rearward most part of the back end 38 and gradually tapers or decreases near the edges of the second coating $\mathbf{50}_2$. For example, the thickness of the second coating $\mathbf{50}_2$ tapers or decreases near the crown 18 and the sole 24 of the club head 2200.

Figure 18:
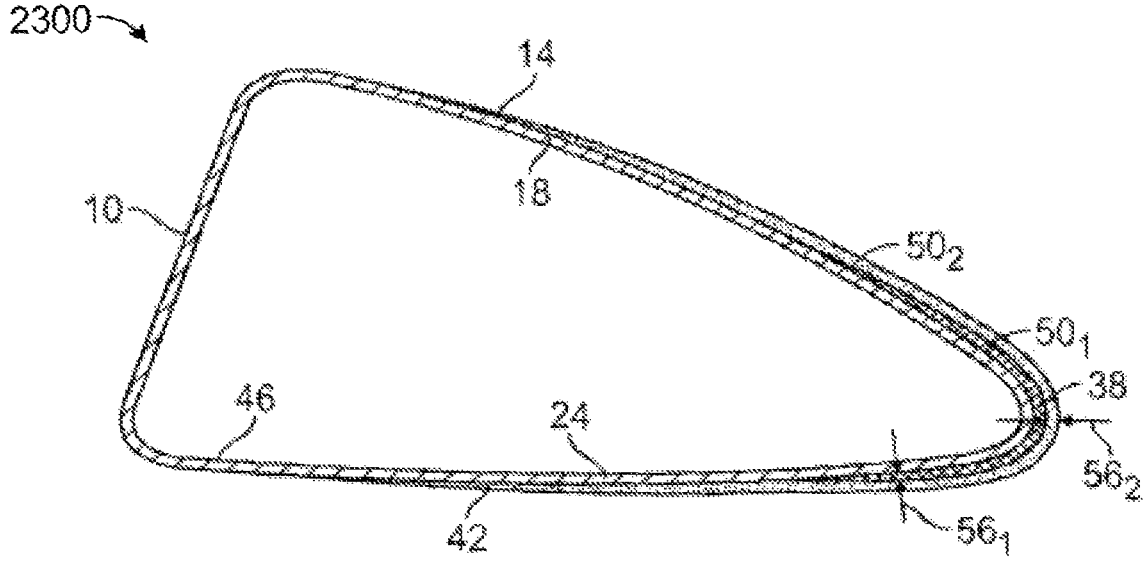
FIG. 18 illustrates a cross sectional view of another embodiment of a golf club head having a first coating and a second coating.

FIG. 18 illustrates another embodiment of the club head 2300 having a strike face 10 and a body 14 including a crown 18, a sole 24 opposite the crown 18, a heel 28, a toe 34 opposite the heel 28, and a back end 38. The body 14 and the strike face 10 together form the club head 2300 having an outer surface 42 and an inner surface 46. The club head 2300 further includes a first coating $\mathbf{50}_1$ and second coating $\mathbf{50}_2$.

Referring to FIG. 18, in the illustrated embodiment, the first coating $\mathbf{50}_1$ is positioned on the outer surface 42 of the club head 2300. Further, the first coating $\mathbf{50}_1$ covers or is positioned over a portion of the club head 2300 including the back end 38. In the illustrated embodiment, the thickness $\mathbf{56}_1$ of the first coating $\mathbf{50}_1$ is greatest near the rearward most part of the back end 38 and gradually tapers or decreases near the edges of the first coating $\mathbf{50}_1$. For example, the thickness of the first coating $50_1$ tapers or decreases near the crown 18 and the sole 24 of the club head 2300.

Further referring to FIG. 18, in the illustrated embodiment, the second coating $50_2$ covers or is positioned over a portion of the first coating $50_1$ and the outer surface 42 of the club head 2300. In the illustrated embodiment, the thickness $56_2$ of the second coating $50_2$ is approximately constant and tapers toward the edges of the second coating $50_2$.

Further referring to FIG. 18, in some embodiments, the first and second coatings $50_1$, $50_2$ can extend along the entire back end 38 from the heel 28 to the toe 34 of the club head 2300. Further, in some embodiments, the first and second coatings $50_1$, $50_2$ can extend along a portion of the back end 38 of the club head 2300. For example, in some embodiments, the first and second coatings $50_1$, $50_2$ can extend along the back end 38 from near the heel 28 to near the toe 34 of the club head 2200.

As described above, FIGS. 3-18 illustrate various embodiments of the club head having a coating or plurality of coatings 50 (e.g. club head 200, 300, 400, 500, 600, 700, 800, 900, 1100, 1200, 1300, 1400, 2000, 2100, 2200, or 2300). The embodiments of the club head having the coating or plurality of coatings 50 described herein are not limited by position. In other embodiments, the coating 50 can be positioned anywhere on the club head. For example, the coating 50 can cover at least a portion of the crown 18, the sole 24, the heel 28, the toe 34, the back end 38, the strike face 10, or any combination thereof on the outer surface 42 of the club head. For further example, the coating 50 can cover at least a portion of the crown 18, the sole 24, the heel 28, the toe 34, the back end 38, the strike face 10, or any combination thereof on the inner surface 46 of the club head.

Further, the embodiments of the club head having one or more coatings 50 (e.g. club head 200, 300, 400, 500, 600, 700, 800, 900, 1100, 1200, 1300, 1400, 2000, 2100, 2200, or 2300) described herein are not limited by number of discrete coating portions. For example, in other embodiments, each of the plurality of coatings 50 can have any number of discrete portions such as 1, 2, 3, 4, 5, 6, 7, 8, 9, 10, or any other number of discrete portions.

Further, the embodiments of the club head having the coating or plurality of coatings 50 (e.g. club head 200, 300, 400, 500, 600, 700, 800, 900, 1100, 1200, 1300, 1400, 2000, 2100, 2200, or 2300) described herein are not limited by number of coatings. For example, in other embodiments, the one or more coatings 50 can include 1, 2, 3, 4, 5, 6, 7, 8, 9, 10, or any other number of coatings.

As described above, FIGS. 15-18 illustrate various embodiments of the club head 2000, 2100, 2200, 2300 having a plurality of coatings 50 including a first coating $50_1$ and a second coating $50_2$ positioned in various locations. In other embodiments, the first coating $50_1$ and the second coating $50_2$ can be positioned anywhere on the club head. For example, the first coating $50_1$ can cover at least a portion of the crown 18, the sole 24, the heel 28, the toe 34, the back end 38, the strike face 10, the hosel 40, or any combination thereof on the outer surface 42 of the club head. For further example, the first coating $50_1$ can cover at least a portion of the crown 18, the sole 24, the heel 28, the toe 34, the back end 38, the strike face 10, the hosel 40, or any combination thereof on the inner surface 46 of the club head. In addition, the second coating $50_2$ can cover at least a portion of the crown 18, the sole 24, the heel 28, the toe 34, the back end 38, the strike face 10, the hosel 40, or any combination thereof on the outer surface 42 of the club head. Further, the second coating $50_2$ can cover at least a portion of the crown 18, the sole 24, the heel 28, the toe 34, the back end 38, the strike face 10, the hosel 40, or any combination thereof on the inner surface 46 of the club head. The second coating $50_2$ may be applied to the club head 200 in the same position as the first coating $50_1$, or the second coating $50_2$ may be applied to the club head 200 in a different position than the first coating $50_1$. Further, the second coating $50_2$ may be applied to at least a portion of the same position as the first coating $50_1$.

Referring to FIGS. 3-14, the embodiments of the club head having one or more coatings 50 (e.g. club head 200, 300, 400, 500, 600, 700, 800, 900, 1100, 1200, 1300, 1400, 2000, 2100, 2200, or 2300) described herein are not limited by coating shape. For example, in other embodiments, the perimeter 62 of the coating 50 can define any shape such as a circle, ellipse, triangle, square, rectangle, or any other polygon or shape with at least one curved surface.

As described above, FIGS. 15-18 illustrate various embodiments of the club head 2000, 2100, 2200, 2300 having a plurality of coatings 50 including a first coating $50_1$ and a second coating $50_2$ having various shapes. In some embodiments, the first coating $50_1$ and the second coating $50_2$ have similar shapes. In other embodiments, the first coating $50_1$ and the second coating $50_2$ can have different shapes. For example, the perimeter 62 of the first coating $50_1$ can define any shape such as a circle, ellipse, triangle, square, rectangle, or any other polygon or shape with at least one curved surface. For further example, the perimeter 62 of the second coating $50_2$ can define any shape such as a circle, ellipse, triangle, square, rectangle, or any other polygon or shape with at least one curved surface.

Referring to FIGS. 3-14, the embodiments of the club head having one or more coatings 50 (e.g. club head 200, 300, 400, 500, 600, 700, 800, 900, 1100, 1200, 1300, 1400, 2000, 2100, 2200, or 2300) described herein are not limited by thickness profile. In other embodiments, the coating can have any thickness profile, such as constant, linear, quadratic, sinusoidal, exponential, or any other suitable profile. For example, thickness 56 of the coating 50 may increase when moving away from the perimeter 62 or the thickness 56 of the coating 50 may decrease when moving away from the perimeter 62. Further, the thickness 56 of the coating 50 may be greatest at any position or plurality of positions on the club head (e.g. club head 200, 300, 400, 500, 600, 700, 800, 900, 1100, 1200, 1300, 1400, 2000, 2100, 2200, or 2300), such as, for example, the crown 18, the sole 24, the heel 28, the toe 34, the back end 38, the strike face 10, the hosel 40, or any combination of the described positions.

In embodiments of the club head 2000, 2100, 2200, 2300 having a plurality of coatings 50 including a first coating $50_1$ and a second coating $50_2$, the first thickness $56_1$ of the first coating $50_1$ can have the same thickness profile as the second thickness $56_2$ of the second coating $50_2$, or the first thickness $56_1$ of the first coating $50_1$ can have a different thickness profile than the second thickness $56_2$ of the second coating $50_2$.

In many embodiments (e.g. club head 100, 200, 300, 400, 500, 600, 700, 800, 900, 1100, 1200, 1300, 1400, 2000, 2100, 2200, 2300), the surface area of the coating 50 may range from approximately 0-70 square inches ($in^2$). For example, the surface area of the coating 50 may be approximately 0, 5, 10, 15, 20, 25, 30, 35, 40, 45, 50, 55, 60, 65, or 70 $in^2$. The surface area of the coating may cover any percentage (i.e. 0%-100%) of the club head surface area. For example, the surface area may cover approximately 5, 10, 15, 20, 25, 30, 35, 40, 45, 50, 55, 60, 65, 70, 75, 80, 85, 90, 95, or 100% of the surface area of the club head 100.

As described above, the surface area of the coating 50 can comprise a single, discrete portion, such as, for example when the coating 50 covers the entire club head (e.g. club head 200) or when the coating 50 covers at least a portion of the crown 18, the sole 24, the heel 28, the toe 34, the back end 38, or the strike face 10 (e.g. club head 300, 400, 500, 600, 800, 1100, 1300, 1400). Conversely, the surface area of the coating 50 can comprise a plurality of discrete portions when the coating 50 includes more than one portion (e.g. club head 700, 900, 1200). For example, the surface area of the coating 50 comprises a plurality of discrete portions when the coating 50 includes a first portion that covers at least a portion of the crown 18 and a second portion that covers at least a portion of the sole 24 (e.g. club head 900). When the coating 50 is divided into a plurality of portions, the sum of the surface areas of each portion define the surface area of the coating 50. In these or other embodiments, the surface area of the coating 50 may range from approximately 0-70 $in^2$. For example, the surface area of the coating 50 may be approximately 0, 5, 10, 15, 20, 25, 30, 35, 40, 45, 50, 55, 60, 65, or 70 $in^2$. Further, the surface area of the coating 50 may cover any percentage (i.e. 0%-100%) of the club head surface area. For example, the surface area of the coating 50 may cover approximately 5, 10, 15, 20, 25, 30, 35, 40, 45, 50, 55, 60, 65, 70, 75, 80, 85, 90, 95, or 100% of the surface area of the club head.

As described above, FIGS. 15-18 illustrate various embodiments of a club head 2000, 2100, 2200, 2300 having a plurality of coatings 50 including a first coating $\mathbf{50}_1$ and a second coating $\mathbf{50}_2$ positioned in various locations. In these or other embodiments, the first surface area of the first coating $\mathbf{50}_1$ may range from approximately 0-70 square inches ($in^2$). For example, the first surface area of the first coating $\mathbf{50}_1$ may be approximately 0, 5, 10, 15, 20, 25, 30, 35, 40, 45, 50, 55, 60, 65, or 70 $in^2$. Further, the first surface area of the first coating $\mathbf{50}_1$ may cover any percentage (i.e. 0%-100%) of the club head surface area. For example, the first surface area of the first coating $\mathbf{50}_1$ may cover approximately 5, 10, 15, 20, 25, 30, 35, 40, 45, 50, 55, 60, 65, 70, 75, 80, 85, 90, 95, or 100% of the surface area of the club head.

Further, in these or other embodiments, the second surface area of the second coating $\mathbf{50}_2$ may range from approximately 0-70 square inches ($in^2$). For example, the second surface area of the second coating $\mathbf{50}_2$ may be approximately 0, 5, 10, 15, 20, 25, 30, 35, 40, 45, 50, 55, 60, 65, or 70 $in^2$. For example, the second surface area of the second coating $\mathbf{50}_2$ may be approximately 0, 5, 10, 15, 20, 25, 30, 35, 40, 45, 50, 55, 60, 65, or 70 $in^2$. Further, the second surface area of the second coating $\mathbf{50}_2$ may cover any percentage (i.e. 0%-100%) of the club head surface area. For example, the second surface area of the second coating $\mathbf{50}_2$ may cover approximately 5, 10, 15, 20, 25, 30, 35, 40, 45, 50, 55, 60, 65, 70, 75, 80, 85, 90, 95, or 100% of the surface area of the club head. Further still, in these or other embodiments, the first surface area of the first coating $\mathbf{50}_1$ can be the same as the second surface area of the second coating $\mathbf{50}_2$, or the first surface area of the first coating $\mathbf{50}_1$ can be different than the second surface area of the second coating $\mathbf{50}_2$.

Referring to Table 1 below, the coating material can be any material capable of being applied to the club head (e.g. club head 200, 300, 400, 500, 600, 700, 800, 900, 1100, 1200, 1300, 1400, 2000, 2100, 2200, or 2300) in a thin layer between 0.10 inches and 0.00001 inches in thickness or depth 56. The coating material can be a particular metal alloy having a coating material density. The density of the coating material can be between 100 $g/in^3$ to 400 $g/in^3$. For example, the coating material density may be 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, or 400 $g/in^3$. In many embodiments, the coating material density is greater than at least one of the body material density or the strike face material density. For example, in some embodiments, the coating material density is greater than the body material density. For further example, in some embodiments, the coating material density is greater than the strike face material density. For further example, in some embodiments, the coating material density is greater than both the body material density and the strike face material density.

The density of the coating material applied to the body 14 of the club head (e.g. club head 200, 300, 400, 500, 600, 700, 800, 900, 1100, 1200, 1300, 1400, 2000, 2100, 2200, or 2300) can be 1.0 times, 1.25 times, 1.50 times, 2.0 times, 2.25 times, 2.50 times, 2.75 times, 3.0 times or higher than the body material density. The density of the coating material applied to the strike face 10 of the club head (e.g. club head 200, 300, 400, 500, 600, 700, 800, 900, 1100, 1200, 1300, 1400, 2000, 2100, 2200, or 2300) can be 1.0 times, 1.25 times, 1.50 times, 2.0 times, 2.25 times, 2.50 times, 2.75 times, 3.0 times or higher than the strike face material density. Further referring to Table 1, the coating material may be beryllium based alloy, a copper based alloy, a palladium based alloy, a tungsten based alloy, a rhenium based alloy, a cobalt based alloy, a rhodium based alloy, a ruthenium based alloy, a molybdenum based alloy, a nickel based alloy, an iron based alloy, or cadium based alloy. The coating material may be a pure-based metal such as pure beryllium, pure copper, pure palladium, pure tungsten, pure rhenium, pure cobalt, pure rhodium, pure ruthenium, pure molybdenum, pure nickel, pure iron, or pure cadium. Table 1 illustrates exemplary coating materials and their densities. The coating material may be any alloy including, but not limited to, cobalt, beryllium, copper alloy, a tungsten carbide alloy, or a tungsten, rhenium alloy.

TABLE 1

Exemplary coating materials and associated coating material densities

| Exemplary Coating Materials | Coating Material Density ($g/in^3$) |
|---|---|
| Cobalt Beryllium Copper | 144.70 |
| Pure Palladium | 199.27 |
| Tungsten Carbide | 256.13 |
| Tungsten Rhenium | 314.96 |
| Pure Tungsten | 316.27 |

The thickness 56 of the coating 50 applied to the body 14 of the club head (e.g. club head 200, 300, 400, 500, 600, 700, 800, 900, 1100, 1200, 1300, 1400, 2000, 2100, 2200, or 2300) can range from approximately 0.00001-0.10 inches to add approximately 1-25 grams, 1-20 grams, 1-15 grams, or 1-10 grams of discretionary weight to the club head 100. The thickness 56 of the coating 50 can be approximately 0.00001 inches (0.254 μm), 0.000025 inches (0.635 μm), 0.00005 inches (1.27 μm), 0.000075 inches (1.905 μm), 0.0001 inches (2.54 μm), 0.00025 inches (6.35 μm), 0.0005 inches (12.7 μm), 0.00075 inches (19.05 μm), 0.001 inches (25.4 μm), 0.0025 inches (63.5 μm), 0.005 inches (127 μm), 0.0075 inches (190.5 μm), 0.01 inches (254 μm), 0.025 inches (635 μm), 0.05 inches (1270 μm), 0.075 inches (1905 μm), or 0.10 inches (2540 μm). The thickness 56 of the coating 50 can range from approximately 0.00001 inches (0.254 μm) to 0.0075 inches (190.5 μm), 000025 inches (0.635 μm) to 0.075 inches (1905 μm), 0.00075 inches (1.905 μm) to 0.05 inches (1270 μm), 0.001 inches (25.4 μm) to 0.025 inches (635 μm), 0.0025 inches (63.5 μm) to 0.01 inches (254 μm), or 0.005 inches (127 μm) to 0.0075 inches (190.5 μm). The thickness 56 of the coating 50 may add approximately 1, 2, 3, 4, 5, 6, 7, 8, 9, 10, 11, 12, 13, 14, 15, 16, 17, 18, 19, 20, 21, 22, 23, 24, or 25 grams of discretionary weight to the club head 100.

In embodiments of the club head 2000, 2100, 2200, 2300 having a plurality of coatings 50 including a first coating $\mathbf{50}_1$ and a second coating $\mathbf{50}_2$. The first coating $\mathbf{50}_1$ can have the same or a different thickness than the second coating $\mathbf{50}_2$. The first thickness $\mathbf{56}_1$ of the first coating $\mathbf{50}_1$ may range from approximately 0.00001-0.10 inches to add approximately 1-25 grams, 1-20 grams, 1-15 grams, or 1-10 grams of discretionary weight to the club head 200. For example, the first thickness $\mathbf{56}_1$ of the first coating $\mathbf{50}_1$ can be approximately 0.00001 inches (0.254 μm), 0.000025 inches (0.635 μm), 0.00005 inches (1.27 μm), 0.000075 inches (1.905 μm), 0.0001 inches (2.54 μm), 0.00025 inches (6.35 μm), 0.0005 inches (12.7 μm), 0.00075 inches (19.05 μm), 0.001 inches (25.4 μm), 0.0025 inches (63.5 μm), 0.005 inches (127 μm), 0.0075 inches (190.5 μm), 0.01 inches (254 μm), 0.025 inches (635 μm), 0.05 inches (1270 μm), 0.075 inches (1905 μm), or 0.10 inches (2540 μm). The thickness 56 of the first coating $\mathbf{50}_1$ can range from approximately 0.00001 inches (0.254 μm) to 0.0075 inches (190.5 μm), 000025 inches (0.635 μm) to 0.075 inches (1905 μm), 0.00075 inches (1.905 μm) to 0.05 inches (1270 μm), 0.001 inches (25.4 μm) to 0.025 inches (635 μm), 0.0025 inches (63.5 μm) to 0.01 inches (254 μm), or 0.005 inches (127 μm) to 0.0075 inches (190.5 μm). For further example, the first coating $\mathbf{50}_1$ may add approximately 1, 2, 3, 4, 5, 6, 7, 8, 9, 10, 11, 12, 13, 14, 15, 16, 17, 18, 19, 20, 21, 22, 23, 24, or 25 grams of discretionary weight to the club head.

Further, the second thickness $\mathbf{56}_2$ of the second coating $\mathbf{50}_2$ may range from approximately 0.00001-0.10 inches to add approximately 1-25 grams, 1-20 grams, 1-15 grams, or 1-10 grams of discretionary weight to the club head 200. For example, the second thickness $\mathbf{56}_2$ of the second coating $\mathbf{50}_2$ may be approximately 0.00001 inches (0.254 μm), 0.000025 inches (0.635 μm), 0.00005 inches (1.27 μm), 0.000075 inches (1.905 μm), 0.0001 inches (2.54 μm), 0.00025 inches (6.35 μm), 0.0005 inches (12.7 μm), 0.00075 inches (19.05 μm), 0.001 inches (25.4 μm), 0.0025 inches (63.5 μm), 0.005 inches (127 μm), 0.0075 inches (190.5 μm), 0.01 inches (254 μm), 0.025 inches (635 μm), 0.05 inches (1270 μm), 0.075 inches (1905 μm), or 0.10 inches (2540 μm). The thickness 56 of the second coating $\mathbf{50}_2$ can range from approximately 0.00001 inches (0.254 μm) to 0.0075 inches (190.5 μm), 000025 inches (0.635 μm) to 0.075 inches (1905 μm), 0.00075 inches (1.905 μm) to 0.05 inches (1270 μm), 0.001 inches (25.4 μm) to 0.025 inches (635 μm), 0.0025 inches (63.5 μm) to 0.01 inches (254 μm), or 0.005 inches (127 μm) to 0.0075 inches (190.5 μm). For further example, the second coating $\mathbf{50}_2$ may add approximately 1, 2, 3, 4, 5, 6, 7, 8, 9, 10, 11, 12, 13, 14, 15, 16, 17, 18, 19, 20, 21, 22, 23, 24, or 25 grams of discretionary weight to the club head. Additional layers including a third coating $\mathbf{50}_3$, fourth coating $\mathbf{50}_4$, or fifth coating $\mathbf{50}_5$ can have similar thicknesses and relationships to the other coating layers as the first $\mathbf{50}_1$ and second coating $\mathbf{50}_2$. In these or other embodiments, the first coating $\mathbf{50}_1$ and the second coating $\mathbf{50}_2$ may be applied to the club head (e.g. club head 2000, 2100, 2200, 2300) such that the first weight of first coating $\mathbf{50}_1$ and the second weight of the second coating $\mathbf{50}_2$ together add a desired discretionary weight of the club head. The total weight of the coating or plurality of coatings 50 (e.g. sum of the first weight and the second weight) can range from approximately 1-25 grams, 1-20 grams, 1-15 grams, or 1-10 grams. For example, the sum of the first weight and the second weight can be approximately 1, 2, 3, 4, 5, 6, 7, 8, 9, 10, 11, 12, 13, 14, 15, 16, 17, 18, 19, 20, 21, 22, 23, 24, or 25 grams.

In many embodiments, the coating or plurality of coatings 50, as described herein, may be used to position discretionary weight to achieve specific head center of gravity positions. For example, the coating 50 may be applied to the club head (e.g. club head 200, 300, 400, 500, 600, 700, 800, 900, 1100, 1200, 1300, 1400, 2000, 2100, 2200, or 2300) at the back end 38 to shift the center of gravity of the club head toward the back end 38. For further example, the coating 50 may be applied to the club head 100, 200 on the sole 24 to shift the center of gravity toward the sole 24. Further still, the coating 50 may be applied to the back end 38 and the sole 24 of the club head to shift the head center of gravity toward the back end 38 and the sole 24. While the examples described herein illustrate the coating 50 positioned to shift the head center of gravity toward the back end 38 and/or the sole 24 of the club head, the coating 50 may be positioned anywhere on the club head to shift the center of gravity in any direction, including toward the crown 18, toward the sole 24, toward the heel 28, toward the toe 34, toward the strike face 10, toward the back end 38, towards at least a portion of the hosel 40, or in any combination of the described directions of the club head to optimize the performance characteristics of the club head. The ability to apply the coating 50 uniformly over the club head or in specific portions of the club head at a micro level allows for precise control of the head center of gravity position.

In many embodiments, the center of gravity of the of club head having coating 50 (e.g. club head 200, 300, 400, 500, 600, 700, 800, 900, 1100, 1200, 1300, 1400, 2000, 2100, 2200, or 2300), can shift by up to approximately 0.05 inches, 0.15 inches, 0.25 inches, 0.35 inches, 0.45 inches, 0.55 inches, 0.65 inches, 0.75 inches, or up to 85 inches in a direction toward the heel 28, toward the toe 34, toward the sole 24, toward the crown 18, toward the strike face 10, toward the back end 38, or any combination of the described directions, compared to a similar club head without a coating.

In many embodiments, the coating 50, as described herein, can also increase the moment of inertia of the club head about an x-axis extending through the center of gravity from the heel 28 to the toe 34, and/or about the y-axis extending through the center of gravity from the crown 18 to the sole 24. In general, club head moment of inertia increases as weight or mass is distributed farther from the head center of gravity. Applying the coating 50 as described herein, allows for positioning of discretionary weight at increased or maximized distances from the head center of gravity. Therefore, the coating 50 of the club head (e.g. club head 200, 300, 400, 500, 600, 700, 800, 900, 1100, 1200, 1300, 1400, 2000, 2100, 2200, or 2300) may be used to increase and/or maximize the moment of inertia of the club head. Increasing the moment of inertia of the club head results in increased consistency in ball direction, trajectory, and distance. Therefore, off-center hits will behave more similarly to on-center hits for the club head having the coating 50.

In many embodiments, the moment of inertia about the x-axis of the club head having the coating 50 (e.g. club head 200, 300, 400, 500, 600, 700, 800, 900, 1100, 1200, 1300, 1400, 2000, 2100, 2200, or 2300) can be increased by up to approximately 2.5%, 5%, 7.5%, 10%, 12.5%, 15%, 17.5%, or 20%, compared to a similar club head without a coating. In other embodiments, the moment of inertia about the x-axis of the club head having the coating 50 can be increased by approximately 1% to 9%, 2.5% to 5%, 5% to 10%, 5% to 15%, or 10% to 20%, compared to a similar club head without a coating. In many embodiments, the moment of inertia about the y-axis of the club head 100, 200 having the coating 50 can be increased by up to approximately 2.5%, 5%, 7.5%, 10%, 12.5%, 15%, 17.5%, or 20%. In other embodiments, the moment of inertia about the y-axis of the club head having the coating 50 can be increased by approximately 1% to 11%, 2.5% to 5%, 5% to 10%, 5% to 15%, or 10% to 20% compared to a similar club head without a coating.

Referring to Tables 2-4 below, the coating material, in combination with the surface area and thickness 56, may be designed to add a desired discretionary weight to the club head (e.g. club head 100, 200, 300, 400, 500, 600, 700, 800, 900, 1100, 1200, 1300, 1400, 2000, 2100, 2200, 2300). For example, Table 2 illustrates exemplary coatings 50 having varying coating material densities, position on the club head (related to surface area), and thicknesses 56 required to add 1 gram of discretionary weight to the club head. For a further example, Table 3 illustrates exemplary coatings 50 having varying coating material densities, positions on the club head (related to surface area), and coating thicknesses 56 required to add 5 grams of discretionary weight to the club head. For a further example, Table 4 illustrates exemplary coatings 50 having varying coating material densities, positions on the club head (related to surface area), and thicknesses 56 required to add 10 grams of discretionary weight to the club head. While the examples illustrated in Tables 2-4 provide exemplary discretionary weights, coating materials, positions, and thicknesses 56 of the coating 50, the same principles apply to add any amount of discretionary weight to the club head, such as, for example, 1, 2, 3, 4, 5, 6, 7, 8, 9, 10, 11, 12, 13, 14, 15, 16, 17, 18, 19, 20, 21, 22, 23, 24, or 25 grams of discretionary weight. For instance, to add 20 grams of weight to the club head, a tungsten carbide coating, having a density of 256.13, requires a coating thickness of 0.00154 inches across the entire body, 0.0134 inches across the face, 0.00170 across the body, 0.00435 across the crown, 0.00435 across the skirt/sole, or 0.01956 across a portion of the sole over a sole weight. Further, the thickness 56 of the coating 50 may be varied for any coating position to adjust the relationship between the coating thickness 56 and coating material, position, and/or discretionary weight.

TABLE 2

Exemplary coating thicknesses for varying coating materials and positions to add 1 gram of discretionary weight to the club head

| | | Coating Position on Club Head and thickness (inches) required for a coating weight of 1 gram | | | | | |
|---|---|---|---|---|---|---|---|
| Coating Material | Coating Material Density (g/in$^3$) | Entire Club Head | Strike face | Body | Crown | Sole | Portion of the sole over a sole weight |
| Ti 8-1-1 | 71.45 | 0.00027 | 0.00233 | 0.00030 | 0.00078 | 0.00078 | 0.00350 |
| Cobalt Beryllium Copper | 144.70 | 0.00013 | 0.00115 | 0.00015 | 0.00038 | 0.00038 | 0.00173 |
| Pure Palladium | 199.27 | 0.00010 | 0.00084 | 0.00011 | 0.00028 | 0.00028 | 0.00125 |
| Tungsten Carbide | 256.13 | 0.00008 | 0.00065 | 0.00008 | 0.00022 | 0.00022 | 0.00098 |
| Tungsten Rhenium | 314.96 | 0.00006 | 0.00053 | 0.00007 | 0.00018 | 0.00018 | 0.00079 |
| Pure Tungsten | 316.27 | 0.00006 | 0.00053 | 0.00007 | 0.00018 | 0.00018 | 0.00079 |

TABLE 3

Exemplary coating thicknesses for varying coating materials and positions to add 5 grams of discretionary weight to the club head

| | | Coating Position on Club Head and thickness (inches) required for a coating weight of 5 grams | | | | | |
|---|---|---|---|---|---|---|---|
| Coating Material | Coating Material Density (g/in$^3$) | Entire Club Head | Strike face | Body | Crown | Sole | Portion of the sole over a sole weight |
| Ti 8-1-1 | 71.45 | 0.00135 | 0.01166 | 0.00152 | 0.00389 | 0.00389 | 0.01749 |
| Cobalt Beryllium Copper | 144.70 | 0.00066 | 0.00576 | 0.00075 | 0.00192 | 0.00192 | 0.00864 |
| Pure Palladium | 199.27 | 0.00048 | 0.00418 | 0.00055 | 0.00139 | 0.00139 | 0.00627 |
| Tungsten | 256.13 | 0.00038 | 0.00325 | 0.00042 | 0.00108 | 0.00108 | 0.00488 |

TABLE 3-continued

| Exemplary coating thicknesses for varying coating materials and positions to add 5 grams of discretionary weight to the club head | | | | | | | |
|---|---|---|---|---|---|---|---|
| | | Coating Position on Club Head and thickness (inches) required for a coating weight of 5 grams | | | | | |
| Coating Material | Coating Material Density (g/in$^3$) | Entire Club Head | Strike face | Body | Crown | Sole | Portion of the sole over a sole weight |
| Carbide Tungsten | 314.96 | 0.00031 | 0.00265 | 0.00035 | 0.00088 | 0.00088 | 0.00397 |
| Rhenium Pure Tungsten | 316.27 | 0.00030 | 0.00263 | 0.00034 | 0.00088 | 0.00088 | 0.00395 |

TABLE 4

| Exemplary coating thicknesses for varying coating materials and positions to add 10 grams of discretionary weight to the club head | | | | | | | |
|---|---|---|---|---|---|---|---|
| | | Coating Position on Club Head and thickness (inches) required for a coating weight of 10 grams | | | | | |
| Coating Material | Coating Material Density (g/in$^3$) | Entire Club Head | Strike face | Body | Crown | Sole | Portion of the sole over a sole weight |
| Ti 8-1-1 | 71.45 | 0.00269 | 0.02333 | 0.00304 | 0.00788 | 0.00778 | 0.03499 |
| Cobalt Beryllium Copper | 144.70 | 0.00133 | 0.01152 | 0.00150 | 0.00384 | 0.00384 | 0.01728 |
| Pure Palladium | 199.27 | 0.00097 | 0.00836 | 0.00109 | 0.00279 | 0.00279 | 0.01255 |
| Tungsten Carbide | 256.13 | 0.00075 | 0.00651 | 0.00085 | 0.00217 | 0.00217 | 0.00976 |
| Tungsten Rhenium | 314.96 | 0.00061 | 0.00529 | 0.00069 | 0.00176 | 0.00176 | 0.00794 |
| Pure Tungsten | 316.27 | 0.00061 | 0.00527 | 0.00069 | 0.00176 | 0.00176 | 0.00790 |

As illustrated in Tables 2-4, the coating 50 having a lower coating material density will require a greater thickness 56 than the coating 50 having a higher coating material density to add the same discretionary weight over the same surface area to the club head. Similarly, the coating 50 having a higher material coating density will require less thickness 56 than the coating 50 having a lower coating material density to add the same discretionary weight over the same surface area to the club head. In general, the coating material density, thickness 56, and/or surface area of the coating 50 may be increased to increase the amount of discretionary weight added to the club head by the coating 50. Similarly, the coating material density, thickness 56, and/or surface area of the coating 50 may be decreased to decrease the amount of discretionary weight added to the club head by the coating 50.

Referring to Tables 2-4, the thickness 56 of the coating 50 may range from approximately 0.00001-0.10 inches to add approximately 1-25 grams, 1-20 grams, 1-15 grams, or 1-10 grams of discretionary weight to the club head 100. For example, the thickness 56 of the coating 50 may be approximately 0.00001, 0.000025, 0.00005, 0.000075, 0.0001, 0.00025, 0.0005, 0.00075, 0.001, 0.0025, 0.005, 0.0075, 0.01, 0.025, 0.05, 0.075, or 0.10 inches. For further example, the thickness 56 of the coating 50 may add approximately 1, 2, 3, 4, 5, 6, 7, 8, 9, 10, 11, 12, 13, 14, 15, 16, 17, 18, 19, 20, 21, 22, 23, 24, or 25 grams of discretionary weight to the club head 100.

Golf Club Head with Surface Roughness Prior to Coating

In other embodiments, the club head 2400 similar to the club heads described above (e.g. 200, 300, 400, 500, 600, 700, 800, 900, 1100, 1200, 1300, 1400, 2000, 2100, 2200, or 2300), comprises of a plurality of coatings 50 including a first coating $\mathbf{50}_1$ and a second coating $\mathbf{50}_2$. The club head in this exemplary embodiment further comprises a surface roughness 68.

The surface roughness 68 of the club head 2400 is formed onto the outer surface 42 of the club head 2400. The surface roughness can be formed on at least a portion of the crown 18, the sole 24, the heel 28, the toe 34, the back end 38, the strike face 10, the hosel 40, or any combination thereof on the outer surface 42 of the club head. For example, the surface roughness 68 is formed on the sole 24 near the back end 38, and equidistant from the toe 34 and the heel 28 of the cub head. In other examples, the surface roughness 68 is formed in the sole 18 near the back end 38 closer to the heel 28, or closer to the toe 34 of the club head.

The surface roughness 68 of the club head 2400 comprises a depth downward into the outer surface 42, wherein the depth ranges between 25 micro inches to 100 micro inches, 25 micro inches to 40 micro inches, 40 micro inches to 55 micro inches, 55 micro inches to 70 micro inches, 70 micro inches to 85 micro inches, or 85 micro inches to 100 micro inches. For example, the depth of the surface roughness can be 25, 30, 35, 40, 45, 50, 55, 60, 65, 70, 75, 80, 85, 90, 95, or 100 micro inches.

As described above in FIGS. 15-18, the first coating $\mathbf{50}_1$ of the club head 2400 can be positioned in various locations on the outer surface 42 of the club head. For example, the first coating $\mathbf{50}_1$ can cover at least a portion of the crown 18, the sole 24, the heel 28, the toe 34, the back end 38, the strike face 10, the hosel 40, or any combination thereof on the outer surface 42 of the club head. Similarly, the first coating $\mathbf{50}_1$ can cover at least just a portion of the surface roughness 68 formed on any portion of the club head, at least just a portion of the outer surface 42 of the club head, or any combination thereof. For example, the first coating $\mathbf{50}_1$ can cover at least a portion of the surface roughness 68 formed on the crown 18, and at least a portion of the surface roughness 68 formed on a portion of the sole 24 near the back end 38. In other embodiments, the first coating $\mathbf{50}_1$ can cover at least a portion of the surface roughness 68 and at least a portion of the outer surface 42 of the club head. For example, the first coating $\mathbf{50}_1$ can cover at least a portion of the surface roughness 68 formed on the sole 24 of the club head, and cover at least a portion of the crown 18.

In some embodiments, the material of the first coating $\mathbf{50}_1$ is a primer. The primer can be an oil alkyd primer, a latex primer, or an organic/inorganic zinc primer such as zinc chromate, zinc rich epoxy, urethane zinc, or any other kind of material that can be applied to the body 14 of the club head. In other embodiments, the material of the first coating $\mathbf{50}_1$ is a non-primer such as a beryllium based alloy, a copper based alloy, a palladium based alloy, a tungsten based alloy, a rhenium based alloy, a cobalt based alloy, a rhodium based alloy, a ruthenium based alloy, a molybdenum based alloy, a nickel based alloy, an iron based alloy, or cadium based alloy. In other embodiments still, the material of the first coating $\mathbf{50}_1$ can be a pure-based metal such as pure beryllium, pure copper, pure palladium, pure tungsten, pure rhenium, pure cobalt, pure rhodium, pure ruthenium, pure molybdenum, pure nickel, pure iron, or pure cadium.

As described above in FIGS. 15-18, the second coating $\mathbf{50}_2$ can cover at least a portion of the crown 18, the sole 24, the heel 28, the toe 34, the back end 38, the strike face 10, the hosel 40, or any combination thereof on the outer surface 42 of the club head. Further, the second coating $\mathbf{50}_2$ can cover at least a portion of just the first coating $\mathbf{50}_1$, just the surface roughness 68, just the outer surface 42 of the club head, or a combination thereof. For example, the second coating $\mathbf{50}_2$ can cover at least a portion of the crown 18. In another example, the second coating $\mathbf{50}_2$ can cover at least a portion of the first coating $\mathbf{50}_1$ positioned on the surface roughness 68 formed on the sole 24 of the club head. In other examples, the second coating $\mathbf{50}_2$ can cover at least a portion of the surface roughness 68 formed on the sole 24 near the toe 34 of the club head.

In some embodiments, the material of the second coating $\mathbf{50}_2$ can be any material that can be applied to a club head. The material of the second coating $\mathbf{50}_2$ can be a beryllium based alloy, a copper based alloy, a palladium based alloy, a tungsten based alloy, a rhenium based alloy, a cobalt based alloy, a rhodium based alloy, a ruthenium based alloy, a molybdenum based alloy, a nickel based alloy, an iron based alloy, or cadium based alloy. In other embodiments, the material of the second coating $\mathbf{50}_2$ can be a pure-based metal such as pure beryllium, pure copper, pure palladium, pure tungsten, pure rhenium, pure cobalt, pure rhodium, pure ruthenium, pure molybdenum, pure nickel, pure iron, or pure cadium.

The first coating $\mathbf{50}_1$ comprises a density, and the second coating $\mathbf{50}_2$ comprises a density. The density of the first coating $\mathbf{50}_1$ can be different from the density of the second coating $\mathbf{50}_2$. In some embodiments, the density of the first coating $\mathbf{50}_1$ is less than the density of the second coating $\mathbf{50}_2$, while in other embodiments, the density of the first coating $\mathbf{50}_1$ is greater than the density of the second coating $\mathbf{50}_2$. Still, in other embodiment, the density of the first coating $\mathbf{50}_1$ can be the same as the density of the second coating $\mathbf{50}_2$.

In many embodiments, the plurality of coatings 50, as described above may be used to position discretionary weight to achieve specific head center of gravity positions. Adjusting the center of gravity can affect the MOI of the club head, as well as the spin and trajectory of the ball. For example, a lower center of gravity near the back end 38, and near the toe 34 can decrease the spin of the ball while maintain a trajectory similar to a club head 2400 having higher loft.

In one example, the plurality of coatings 50 can be applied to the sole 24 near the back end 38 to shift the center of gravity toward the sole 24 and the back end 38 of the club head. Further upon this example, the plurality of coatings 50 can be applied more near the toe 34 to shift the center of gravity toward the toe 34 of the club head. In some embodiments, the center of gravity of the club head 2400 can shift from 0.2 inches to 0.48 inches toward the sole 24 of the club head, from 0.01 inches to 0.26 inches toward the back end 38 of the club head, and from 0.005 inches to 0.065 inches toward the toe 34. For example, the center of gravity can shift toward the sole 24 by 0.02 inches, 0.05 inches, 0.10 inches, 0.15 inches, 0.20 inches, 0.25 inches, 0.30 inches, 0.35 inches, 0.40 inches, 0.45 inches, or 0.48 inches; while the center of gravity can further shift toward the back end 38 by 0.01 inches, 0.03 inches, 0.06 inches, 0.09 inches, 0.12 inches, 0.15 inches, 0.18 inches, 0.21 inches, or 0.26 inches; while the center of gravity can further still shift toward the toe 34 by 0.005 inches, 0.010 inches, 0.015 inches, 0.020 inches, 0.025 inches, 0.030 inches, 0.035 inches, 0.040 inches, 0.045 inches, 0.050 inches, 0.055 inches, 0.060 inches, and 0.065 inches compared to a club head 2400 with no coating.

In one example, the plurality of coatings 50 can be applied to a portion of the sole near the heel or a portion of the sole near the toe. In another example, the plurality of coatings 50 can be applied to both a portion of the sole near the heel and a portion of the sole near the toe, as illustrated in FIG. 12. In some embodiments, the center of gravity of the club head 1200 of FIG. 12 or the club head 1300 of FIG. 13 can shift from 0.01 inches to 0.07 inches toward the sole 24 of the club head, from 0.005 inches to 0.10 inches toward the back end 38 of the club head, and from 0.005 inches to 0.055 inches toward the toe 34. For example, the center of gravity can shift toward the sole 24 by 0.01 inches, 0.02 inches, 0.03 inches, 0.04 inches, 0.05 inches, 0.06 inches, or 0.07 inches; while the center of gravity can further shift toward the back end 38 by 0.005 inches, 0.008 inches, 0.010 inches, 0.02 inches, 0.03 inches, 0.04 inches, 0.05 inches, 0.06 inches, 0.07 inches, 0.08 inches, 0.09 inches, or 0.10 inches; while the center of gravity can further still shift toward the toe 34 by 0.005 inches, 0.010 inches, 0.015 inches, 0.020 inches, 0.025 inches, 0.030 inches, 0.035 inches, 0.040 inches, 0.045 inches, 0.050 inches, or 0.055 inches, compared to a club head 1200 or 1300 with no coating.

In other embodiments of the club heads 1200 and 1300 with the plurality of coatings 50, the center of gravity of the club head 1200 or club head 1300 can shift from 0.005 inches to 0.25 inches toward the strike face 10 of the club head and 0.005 inches to 0.095 inches toward the heel 28. For example, the center of gravity can shift toward the strike face 10 by 0.005 inches, 0.01 inches, 0.03 inches, 0.06 inches, 0.09 inches, or 0.095 inches; while the center of gravity can further shift toward the heel 28 by 0.005 inches, 0.01 inches, 0.02 inches, 0.03 inches, 0.04 inches, 0.05 inches, 0.06 inches, 0.07 inches, 0.08 inches, 0.09 inches, or 0.095 inches, compared to a club head 1200 or 1300 with no coating.

In many embodiments the plurality of coatings 50 can increase the moment of inertia about the x-axis extending through the center of gravity from the heel 28 to the toe 34, and/or about the y-axis extending through the center of gravity from the crown 18 to the sole 24. Increasing the moment of inertia of the club head 2400 can increase the consistency of ball direction, trajectory, and distance. Therefore, the club head 2400 is more forgiving for off-center shots.

In one example, the plurality of coatings 50 can be applied to the sole 24 near the back end 38, and more near the toe 34 to increase the moment of inertia about the x-axis by 7.5% to 11.0% and increase the moment of inertia about the y-axis by 2.5% to 5.5%. For example, the moment of inertia about the x-axis can increase by 7.5%, 7.8%, 8.1%, 8.4%, 8.7%, 9.0%, 9.3%, 9.6%, 9.9%, 10.2%, 10.5%, 10.8%, or 11.0%; while the moment of inertia about the y-axis by 2.5%, 2.8%, 3.1%, 3.4%, 3.7%, 4.0%, 4.3%, 4.6%, 4.9%, 5.2%, or 5.5%, compared to a similar club head 2400 with no coating.

The plurality of coatings 50 can further affect the statistical area of the club head. The statistical area of the club head 2400 is the area in which the ball lands consecutively with the same swing conditions (i.e. the swing, the stance, environmental conditions). The smaller the statistical area of the club head, the more consistent the shots in where they land. More consistent shots allow for a player to better gauge the landing and distance of the ball. In some embodiments, the plurality of coatings 50 applied onto the surface roughness can decrease the statistical area of the ball flight ranging from 10% to 24%. For example, the statistical area of the ball flight can be 10%, 12%, 14%, 16%, 18%, 20%, 22% or 24%, compared to a similar club head 2400 without a plurality of coatings 50.

The plurality of coatings 50 further affects the spin rate of the ball. A high ball spin rate increases the chance the ball will roll backwards upon landing, thus losing distance. Likewise, the lower the ball spin rate, the lower the chance the ball will roll backwards, but instead roll forward, thus increasing distance. The plurality of coatings 50 applied to the club head 2400 decreases the spin rate of the ball by 190 rpm to 230 rpm, while maintaining the same launch angle as a similar club head 2400 without any coating. For example, the plurality of coatings 50 can decrease the ball spin rate by 190 rpm, 195 rpm, 200 rpm, 205 rpm, 210 rpm, 215 rpm, 220 rpm, 225 rpm, or 230 rpm, compared to a similar club head 2400 without any coating.

Figure 20:
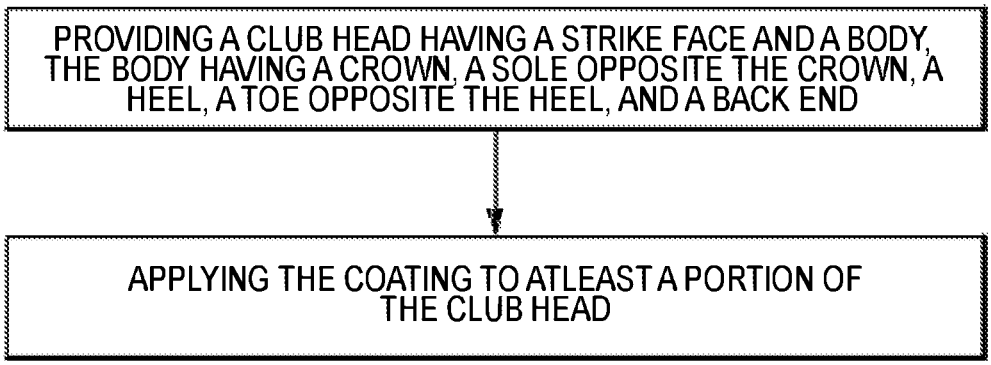
FIG. 20 illustrates a method of manufacturing a golf club head having a coating.

FIG. 20 illustrates a method of manufacturing the club head (e.g. club head 100, 200, 300, 400, 500, 600, 700, 800, 900, 1100, 1200, 1300, 1400, 2000, 2100, 2200, 2300). The method includes providing a club head having a strike face 10 and a body 14 with a crown 18, a sole 24 opposite the crown 18, a heel 28, a toe 34 opposite the heel 28, and a back end 38, and applying at least one coating 50 to at least a portion of the club head 100. The coating 50 may be applied to a surface of the club head by vapor deposition, plasma spray, plating, or spotting. The process of applying the coating 50 may involve spraying the club head with a powered material under high pressure at approximately room temperature. Further, the coating 50 may be applied to the club head using any other process capable of applying the coating 50 to the club head in a thin layer.

Figure 21:
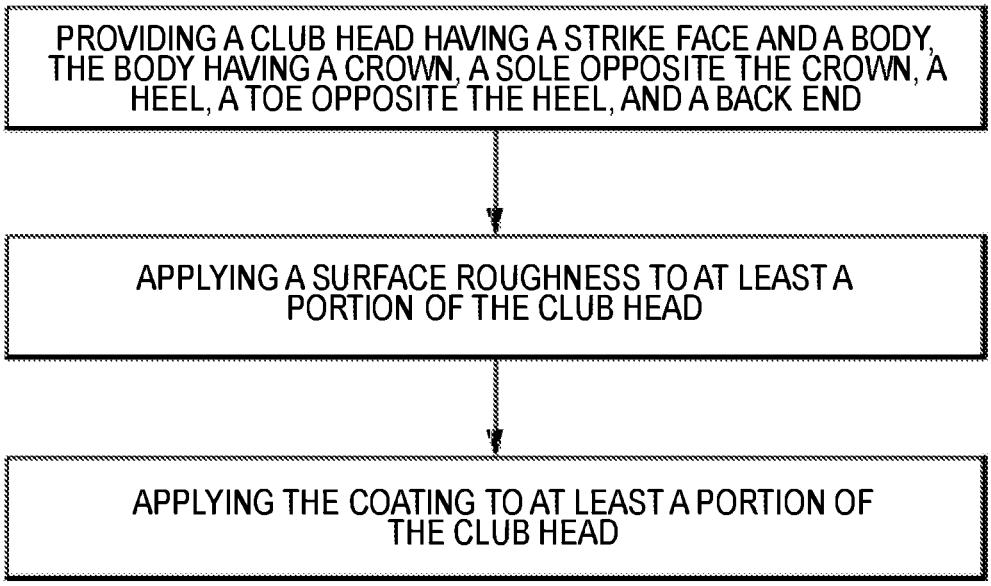
FIG. 21 illustrates a method of manufacturing a golf club head having a surface roughness and a coating.

FIG. 21 illustrates a method of manufacturing the club head 2400. The method is similar to the method described above of FIG. 20, but further comprises applying a surface roughness 68 to the outer surface 42 of club head provided 2400 prior to applying a plurality of coatings 50. The process of applying a surface roughness 68 to the outer surface 42 of the club head 2400 may involve grinding, sand, sand blasting, abrasive blasting, laser texturing, or any process of creating surface texture on a club head. The outer surface 42 can be roughened using various types of blast media, including but not limited to, beaded titanium and beaded stainless steel alloy. In some embodiments, the surface roughness 68 can range from 30 to 180 microinches (μin) deep. For example, the surface roughness 68 can be 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, or 180 μin deep.

The methods of manufacturing and providing a club head club head of FIGS. 20 and 21 may comprise polishing the head after casting to remove excess gate material and clean the surface. Polishing can further help remove surface porosity. In some embodiments of the methods, before application of the coating, at least a portion of the club head's outer surface 42 is cleaned using air to remove excess media and dust. In other embodiments of the methods, before application of the coating, at least a portion of the club head's outer surface 42 is cleaned using liquid to remove excess media and dust. The cleaning liquid may comprise acetone, isopropyl alcohol, or any other suitable liquid. In other embodiments of the methods, any suitable cleaning mechanism can be employed to remove excess media and dust. Furthermore, in some embodiments of the methods of manufacturing, a target area is masked with guiding tape before the layers are applied to the target area.

The method of manufacturing club head of FIGS. 20 and 21 may also be used to manufacture club head 200, 300, 400, 500, 600, 700, 800, 900, 1100, 1200, 1300, 1400, 2000, 2100, 2200, 2300, and 2400 by repeating the process of applying the coating for the second coating, third coating, fourth coating, and/or fifth coating of the club head. Further, the method of manufacturing the club head is merely exemplary and is not limited to the embodiments presented herein. The method can be employed in many different embodiments or examples not specifically depicted or described herein. In some embodiments, the processes of the method described can be performed in any suitable order. In other embodiments, one or more of the processes may be combined, separated, or skipped.

In the illustrated embodiments, the club heads (e.g. club head 100, 200, 300, 400, 500, 600, 700, 800, 900, 1100, 1200, 1300, 1400, 2000, 2100, 2200, 2300, 2400) are shown as a wood-type club head. However, the club head may be any type of club head including a wood-type club head (e.g., driver or fairway wood), an iron-type club head (e.g., iron or wedge), or a putter-type club head. Further, the embodiments described herein illustrate the club head having the coating on the outer surface 42 of the club head. In other embodiments, the coating may be applied to the inner surface 46 of the club head to achieve similar results.

EXAMPLES

Example 1

Referring to FIGS. 10A and 10B, an exemplary club head 900 having the coating 50 comprising tungsten carbide (density of approximately 256.13 g/in$^3$), with a first portion positioned over the entire crown 18 and a second portion positioned over the entire sole 24, each portion having a thickness 56 of approximately 0.001 inches, and adding a total of approximately 9.9 grams of weight to the club head 900 shifted the center of gravity approximately 0.076 inches toward the toe 34, approximately 0.050 inches toward the crown 18, and approximately 0.020 inches toward the back end 38, compared to a similar club head without the coating. Further, in this example, the coating 50 increased the moment of inertia about the x-axis by approximately 5.3%, and increased the moment of inertia about the y-axis by approximately 4.5%, compared to a similar club head without the coating.

Example 2

Referring to FIG. 11, an exemplary club head 1100 having the coating 50 comprising tungsten carbide (density of approximately 256.13 g/in$^3$), positioned over the entire sole 24, having a thickness 56 of approximately 0.009 inches, and adding approximately 11.4 grams of weight to the club head 1100 shifted the center of gravity by approximately 0.014 inches toward the toe 34, approximately 0.055 inches toward the sole 24, and approximately 0.085 inches toward the back end 38, compared to a similar club head without the coating. Further, in this example, the coating 50 increased moment of inertia about the x-axis by approximately 8.1%, and increased the moment of inertia about the y-axis by approximately 8.6%, compared to a similar club head without the coating.

Example 3

Referring to FIG. 12, an exemplary club head 1200 having the coating 50 comprising tungsten carbide (density of approximately 256.13 g/in$^3$), with a first portion positioned over the a portion of the sole 24 near the toe 34 and a second portion positioned over a portion of the sole 24 near the heel 28, each portion having a thickness 56 of approximately 0.006 inches, and adding a total of approximately 8.2 grams of weight to the club head shifted the center of gravity by approximately 0.045 inches toward the toe 34, approximately 0.010 inches toward the sole 24, and approximately 0.020 inches toward the back end 38, compared to a similar club head without the coating. Further, in this example, the coating 50 increased the moment of inertia about the x-axis by approximately 2.2%, and increased the moment of inertia about the y-axis by approximately 3.5%, compared to a similar club head without the coating.

Example 4

Referring to FIG. 13, an exemplary club head 1300 having the coating 50 comprising tungsten carbide (density of approximately 256.13 g/in$^3$), positioned over a portion of the sole 24 near the heel 28, having a thickness 56 of approximately 0.009 inches, and adding approximately 9.0 grams of weight to the club head 1300 shifted the center of gravity by approximately 0.082 inches toward the heel 28, approximately 0.010 inches toward the sole 24, and approximately 0.190 inches toward the strike face 10, compared to a similar club head without the coating. Further, in this example, the coating 50 increased the moment of inertia about the x-axis by approximately 5.5%, and increased the moment of inertia about the y-axis to approximately 2.7%, compared to a similar club head without the coating.

Example 5

Referring to FIG. 14, an exemplary club head 1400 having the coating 50 comprising tungsten carbide (density of approximately 256.13 g/in$^3$), positioned over the entire sole 24, having a thickness 56 of approximately 0.002 inches, and adding approximately 10.3 grams of weight to the club head 1300 shifted the center of gravity by approximately 0.010 inches toward the toe 34, approximately 0.055 inches toward the sole 24, and approximately 0.050 inches toward the back end 38, compared to a similar club head without the coating. Further, in this embodiment, the coating 50 increased the moment of inertia about the x-axis by approximately 4.2%, and increased the moment of inertia about the y-axis by approximately 4.4%, compared to a similar club head without the coating.

Example 6

Figure 19:
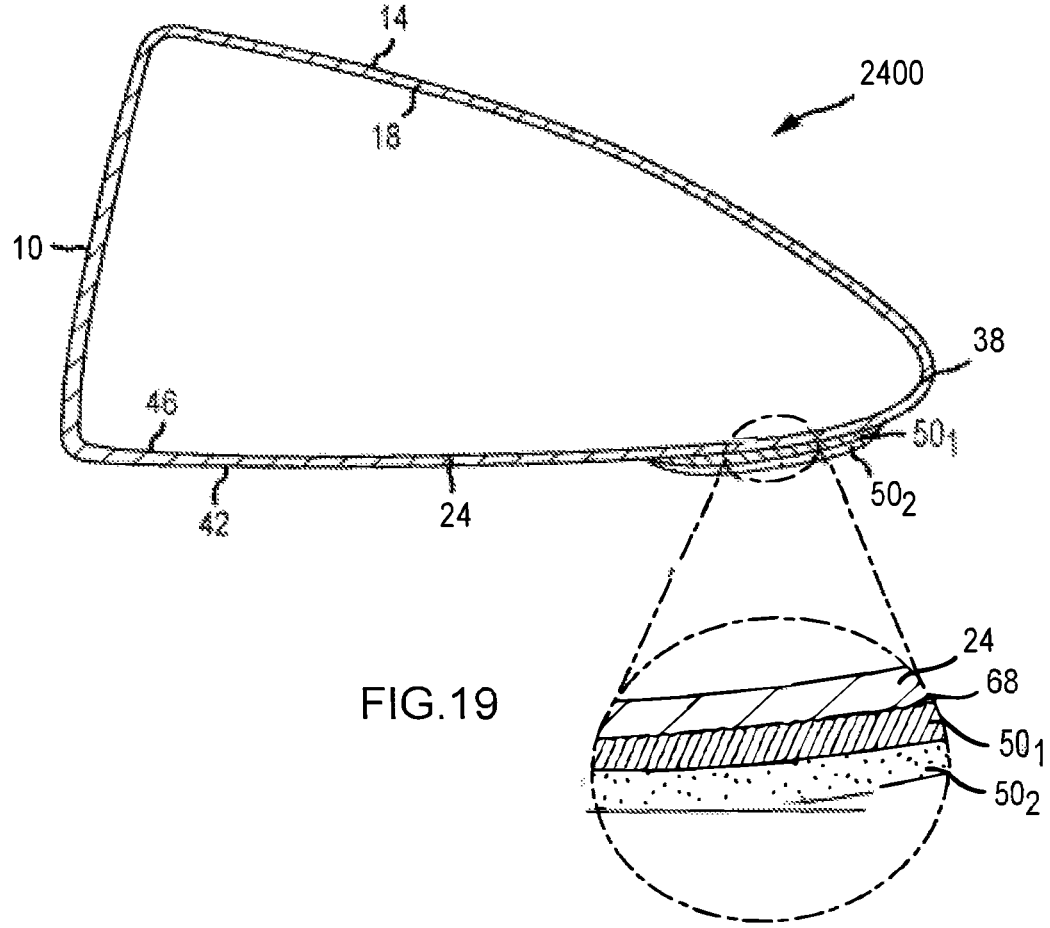
FIG. 19 illustrates a cross-sectional view of another embodiment of a golf club head having a surface roughness, a first coating, and a second coating.

Referring to FIG. 19, an exemplary club head 2400, comprising a surface roughness 68 formed on the sole 24 near the back end 38, further comprises a first coating $\mathbf{50}_1$ covering the surface roughness 68, and further still comprising a second coating $\mathbf{50}_2$, covering the first coating $\mathbf{50}_2$ adds approximately 10.9 grams of weight to the club head. The added weight by the first and second coating $\mathbf{50}_1$ and $\mathbf{50}_2$ at that distinct location shifted the center of gravity of the club head by approximately 0.042 inches toward the toe 34, approximately 0.28 inches toward the sole 24, and approximately 0.11 inches toward the back end 38, compared to a similar club head 2400 with the surface roughness and coating. Further in this embodiment, the first and second coating $\mathbf{50}_1$ and $\mathbf{50}_2$ increased the moment of inertia about the x-axis by approximately 7.7%, and increased the moment of inertia about the y-axis by approximately 4.3%, compared to a similar club head without the surface roughness and coating. Further still in this embodiment, the first and second coating $\mathbf{50}_1$ and $\mathbf{50}_2$ comprised a 17% smaller statistic area, and a 215 rpm less spin with a similar launch angle, compared to a club head without the surface roughness, and coating.

Example 7

Referring to FIG. 11, a first exemplary embodiment of the club head 1100, further comprises a surface roughness 68 (not shown in FIG. 11) formed on the sole 24 near the back end 38. The club head 1100 further comprises a first coating $\mathbf{50}_1$ covering the surface roughness 68, and further still comprising a second coating $\mathbf{50}_2$ covering the first coating $\mathbf{50}_1$, together adding approximately 10.0 grams of weight to the club head. For example, the first coating comprises a primer and the second coating comprises a high density material. In a second exemplary embodiment of the club head 1100, only a first coating $\mathbf{50}_1$ is applied over the surface roughness 68, adding approximately 10.0 grams of weight to the club head. For example, the first coating $\mathbf{50}_1$ comprises a high density material, and no primer is applied between the club head and the first coating $50_1$.

According to a test that compared three control heads to three heads of the first exemplary embodiment and to three heads of the second exemplary embodiment, the center of gravity of the club head was shifted further toward the toe 34, lower toward the sole 24, and further toward the back end 38. Table 5 below shows the averages of the CG locations as measured with an x-coordinate axis extending positively from the center of mass towards the heel of the club head and parallel to the ground plane, a y-coordinate axis extending positively from the center of the sole towards the crown and perpendicular to the ground plane, and a z-coordinate axis extending positively rearward from the club strike face and parallel to the ground plane. The results show that, on average, the added weight of the first and second coating $50_1$ and $50_2$ of the first exemplary embodiment at the distinct rear location shifted the center of gravity of the club head by approximately 0.020 inches toward the toe 34, approximately 0.140 inches toward the sole 24, and approximately 0.076 inches toward the back end 38, compared to a similar club head 1100 with no coating. This shift in the center of gravity improves performance characteristics of the golf club. The test results also showed that, on average, the added weight of the first coating $50_1$ of the second exemplary embodiment, at the distinct rear location, shifted the center of gravity of the club head by approximately 0.034 inches toward the toe 34, approximately 0.047 inches toward the sole 24, and approximately 0.080 inches toward the back end 38. Testing shows that this shift in the center of gravity increased the carry yard distance by 0.9 yards, as expected from the center of gravity data.

TABLE 5

Exemplary locations of CG position within various embodiments

| Type of club head | X-axis CG | Y-axis CG | Z-axis CG |
|---|---|---|---|
| First exemplary embodiment (with primer and high density layer) | −0.0053 | 0.92 | 1.836 |
| Second exemplary embodiment (with high density layer) | −0.007 | 1.013 | 1.840 |
| Control club head | 0.028 | 1.060 | 1.760 |

The spin rate was shown to decrease by 6.7% for the second exemplary embodiment. The second exemplary embodiment showed a spin rate of 2983 rpms as compared to a spin rate of 3198 rpms for the control club. The lower spin rate reduces unwanted roll once the ball lands on the ground, which results in a player hitting more accurate shots. The statistical area, representing the area within which test shots land, for the second exemplary embodiment, covers around 1009 square yards, which is 14.5% less area than is covered by a similar control club. The statistical area for a similar control club head covers around 1180 square yards. This test shows that a first coating on a portion of the sole 24 near the rear increases the performance precision of a golf club head, allowing a player to hit more consistent shots.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A golf club head comprising:

a body comprising a body material having a body material density, the body including:

a crown, a sole opposite the crown, a heel, a toe opposite the heel, and a back end;

a strike face made of a strike face material having a strike face material density;

an outer surface;

an inner surface;

a weight pad or a weight member; and a plurality of coatings;

wherein a first coating is positioned directly on and in contact with the outer surface of a portion of the sole near the back end of the club head, the first coating consisting of a first coating material having a first coating material density;

wherein the first coating material density is greater than the body material density;

the first coating material density is between 150 g/in$^3$ and 400 g/in$^3$;

the first coating comprises a thickness greater than 0.00001 inch and less than 0.001 inch; and the body material comprises titanium;

wherein the first coating covers over the weight pad or the weight member of the golf club head;

wherein a shape of the first coating consists of a shape of the weight pad or the weight member; and wherein a second coating is in contact with and covers at least a portion of an outer surface of the first coating.

2. The golf club head of claim 1, wherein the strike face material is the same as the body material, and the first coating material is different than the strike face material and the body material; and wherein a second coating material is different from the first coating material.

3. The golf club head of claim 1, wherein the strike face material is different than the body material, and the first coating material is different than the strike face material or the body material.

4. The golf club head of claim 1, wherein the first coating further comprises a surface area greater than 0 $in^2$ and less than 70 $in^2$.

5. The golf club head of claim 1, wherein a weight of the first coating ranges from 1-15 grams; and wherein a sum of the weight of the first coating and a weight of the second coating is in a range of 1-25 grams.

6. The golf club head of claim 1, wherein the first coating material and the second coating material are each chosen from a group consisting of: cobalt beryllium copper, pure palladium, tungsten carbide, tungsten rhenium, and pure tungsten.

7. The golf club head of claim 1, wherein the first coating material density and a second coating material density are each between 175 $g/in^3$ and 400 $g/in^3$.

8. A golf club head comprising:

a body comprising a body material having a body material density, the body including:

a crown;

a sole opposite the crown;

a heel;

a toe opposite the heel; and a back end;

a strike face made of a strike face material having a strike face material density;

an outer surface;

an inner surface;

a weight pad or a weight member; and a plurality of coatings;

wherein a first coating is positioned directly on and in contact with an outer surface of the sole at a first portion and a second portion;

wherein, the first portion covers an area of the sole between the toe and the back end, and the second portion covers an area of the sole between the heel and the back end; and wherein the first coating consisting of a first coating material having a first coating material density;

wherein the first coating material density is greater than the body material density;

the first coating material density is between 150 $g/in^3$ and 400 $g/in^3$;

the first coating comprises a thickness greater than 0.00001 inch and less than 0.001 inch; and the body material comprises titanium;

wherein the first coating covers over the weight pad or the weight member of the golf club head;

wherein a shape of the first coating consists of a shape of the weight pad or the weight member; and wherein a second coating is in contact with and covers at least a portion of an outer surface of the first coating.

9. The golf club head of claim 8, wherein the strike face material is the same as the body material, and the first coating material is different than the strike face material and the body material;

and wherein a second coating material is different from the first coating material.

10. The golf club head of claim 8, wherein the strike face material is different than the body material, and the first coating material is different than the strike face material or the body material.

11. The golf club head of claim 8, wherein the first coating further comprises a surface area greater than 0 $in^2$ and less than 70 $in^2$.

12. The golf club head of claim 8, wherein a weight of the first coating ranges from 1-15 grams;

wherein a second coating weight ranges from 1-15 grams; and wherein a sum of the weight of the first coating and the second coating weight is between 1-25 grams.

13. The golf club head of claim 8, wherein the first coating material and a second coating material are each selected from a group consisting of: cobalt beryllium copper, pure palladium, tungsten carbide, tungsten rhenium, and pure tungsten.

14. The golf club head of claim 8, wherein the first coating material density and a second coating material density are each between 175 $g/in^3$ and 400 $g/in^3$.

* * * * *